US007407336B2

(12) United States Patent
Giacomo

(10) Patent No.: US 7,407,336 B2
(45) Date of Patent: Aug. 5, 2008

(54) PAINT FEEDER AND PAINTING DEVICE

(76) Inventor: Massimi Giacomo, Via Giovanni XXIII 46, Caleppio Di Settala (IT) 1-20090

( * ) Notice: Subject to any disclaimer, the term of this patent is extended or adjusted under 35 U.S.C. 154(b) by 439 days.

(21) Appl. No.: 10/513,036

(22) PCT Filed: Dec. 9, 2002

(86) PCT No.: PCT/EP02/13956

§ 371 (c)(1),
(2), (4) Date: Nov. 1, 2004

(87) PCT Pub. No.: WO03/099462

PCT Pub. Date: Dec. 4, 2003

(65) Prior Publication Data

US 2005/0232684 A1 Oct. 20, 2005

(30) Foreign Application Priority Data

May 27, 2002 (IT) ..... MI2002A1140

(51) Int. Cl.
*A47L 13/22* (2006.01)
*B43M 11/02* (2006.01)
*A46B 11/06* (2006.01)

(52) U.S. Cl. ..... 401/287; 401/219; 401/282; 401/285; 401/289

(58) Field of Classification Search ..... 401/208, 401/219, 270, 282, 284, 285, 287, 289
See application file for complete search history.

(56) References Cited

U.S. PATENT DOCUMENTS

| | | | | |
|---|---|---|---|---|
| 1,342,211 | A * | 6/1920 | Hainsey | 401/278 |
| 2,817,869 | A | 12/1957 | Hughes | |
| 2,955,310 | A | 10/1960 | Wichern | |
| 3,195,170 | A * | 7/1965 | Howard | 401/188 R |
| 3,427,115 | A * | 2/1969 | Jolly | 401/219 |
| 3,640,630 | A | 2/1972 | Walker | |
| 3,826,581 | A | 7/1974 | Henderson | |
| 4,175,300 | A | 11/1979 | McGlew et al. | |
| 4,537,522 | A | 8/1985 | Charney et al. | |
| 4,566,816 | A | 1/1986 | Janssen | |
| 4,639,156 | A | 1/1987 | Stern et al. | |
| 5,614,021 | A * | 3/1997 | Catlin | 118/258 |

FOREIGN PATENT DOCUMENTS

| | | | |
|---|---|---|---|
| CH | 548 230 | A | 4/1974 |
| EP | 0 122 832 | A | 10/1984 |
| GB | 2 142 386 | A | 1/1985 |
| JP | 56 049111 | A | 5/1981 |

* cited by examiner

*Primary Examiner*—David J Walczak
(74) *Attorney, Agent, or Firm*—Nixon & Vanderhye, PC

(57) ABSTRACT

A paint or varnish feeder for a painting device comprises at least one manifold (13; 33; . . . ) with openings or small dispensing channels (15; 55; . . . ). The at least one manifold (13; 33; . . . ) is fed through at least one pipe (16; . . .) starting from a container in which a slight pressure is created. The small dispensing channels (15; 55; . . . ) can have various configurations in the various embodiments.

9 Claims, 25 Drawing Sheets

FIG 20a
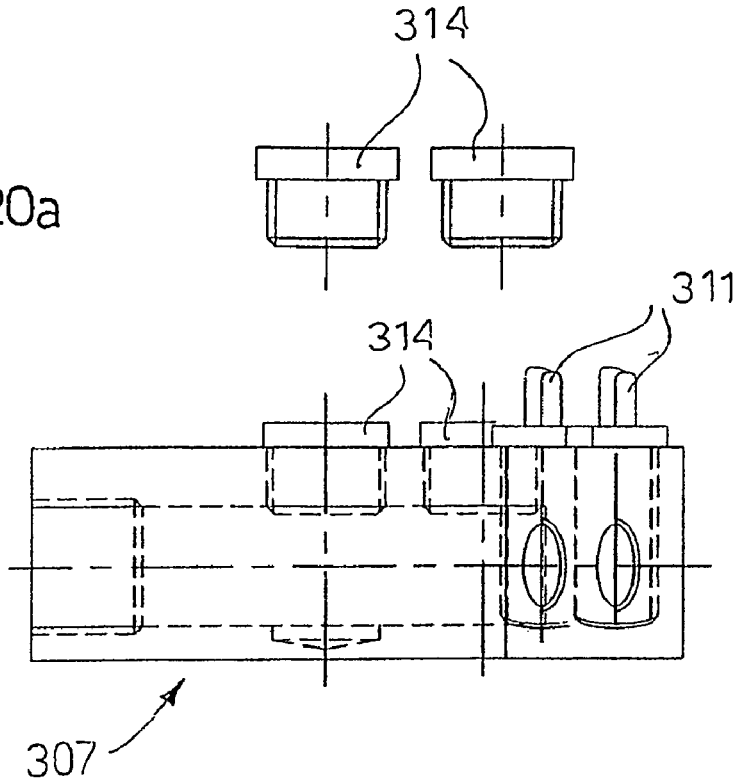
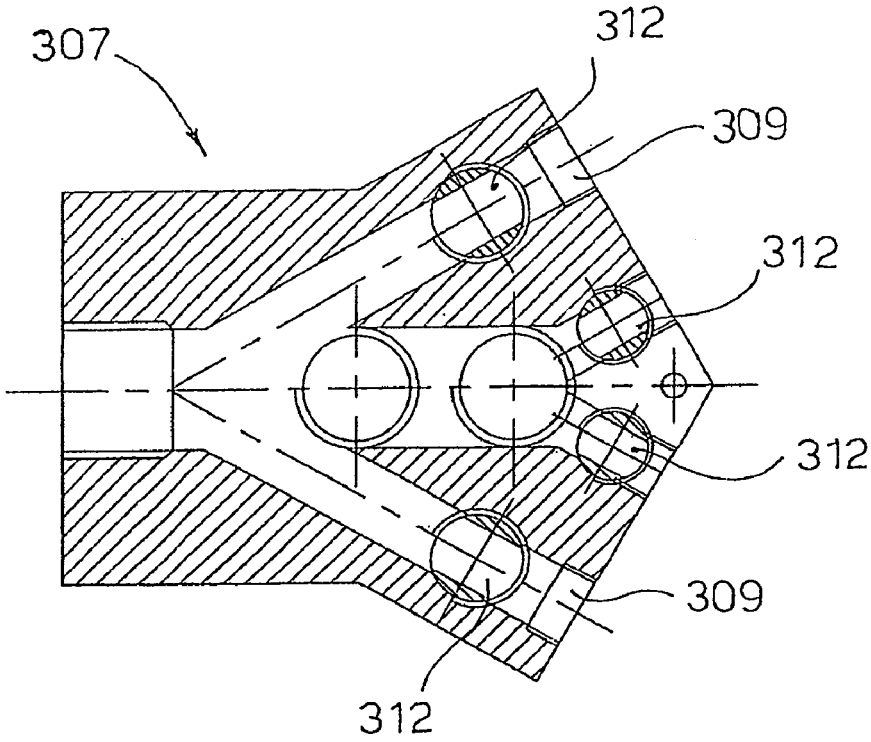
FIG. 20b

PAINT FEEDER AND PAINTING DEVICE

This application is the U. S. national phase of International Application PCT/EPO2/13956 filed 9 Dec. 2002 which designated the U.S. and claims benefit of Italian MI2002A001140 filed 27 May 2002, the entire content of which is hereby incorporated by reference.

The present invention refers to the field of devices for applying varnish or paint to a surface, especially but not only for painting walls, both vertical and horizontal (floors or ceilings).

A known method is to use a brush or a roller for instance to whitewash a wall. The brush, or the roller, is used by soaking in a container with paint, then eliminating the excess paint in various ways, and then passing the brush or roller over the wall several times, until the paint on the brush or roller has been used up after which the brush or roller is again soaked in the container. The system used leaves ample room for personal skill and experience, which means that a beginner can easily achieve bad or irregular results. Furthermore, the quantity of paint or varnish distributed is not uniform at each brush stroke but gradually fades from the first stroke to the last before soaking the brush again. Furthermore, the movements required replenishing the brush or roller with paint use up energy and time.

The object of this invention is to facilitate and make the job of varnishing or, more generally, of painting, less tiring.

A further object is to make it possible for even unskilled persons to achieve better results.

A further object is to achieve the above at low costs.

Such objects have been achieved with a feeder as indicated in claim 1, and a painting device as indicated in claim 7.

In other words, this invention relates to a paint or varnish applier or feeder comprising a distributor part and a supply duct in fluid communication with said distributor part. The distributor part provides several dispensing openings and fastening means to a brush or roller. The supply duct preferably extends as far as a paint supply preferably consisting of a tank under slight pressure, or suitable for being placed under slight pressure. The applier can be made in various shapes.

This invention also applies to a painting device having an applier.

The invention achieves the aforementioned aims, in particular it makes possible having a regulated supply of varnish or paint on the painting device, without the need to perform tiring movements that require time, furthermore it makes it possible to achieve more uniform results than are possible using a traditional painting method.

Examples of embodiment of the invention, which are merely illustrative and not limitative, will be described below with reference to the attached drawings, in which:

FIG. 1 is an axonometric view of a first embodiment of a painting device (brush with long handle) providing a first embodiment of an applier in accordance with the invention;

FIG. 1*a* shows a variation (brush with short handle) of the device in FIG. 1;

Figure 12B:
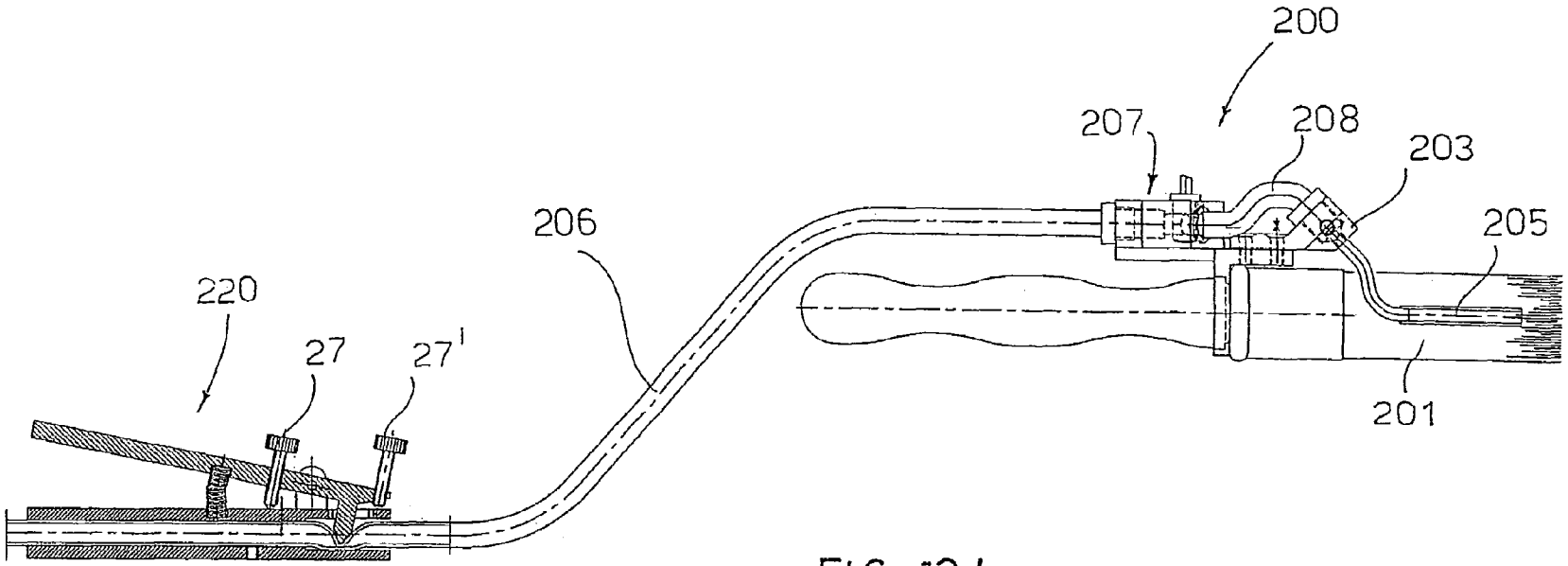
Figure 12A:
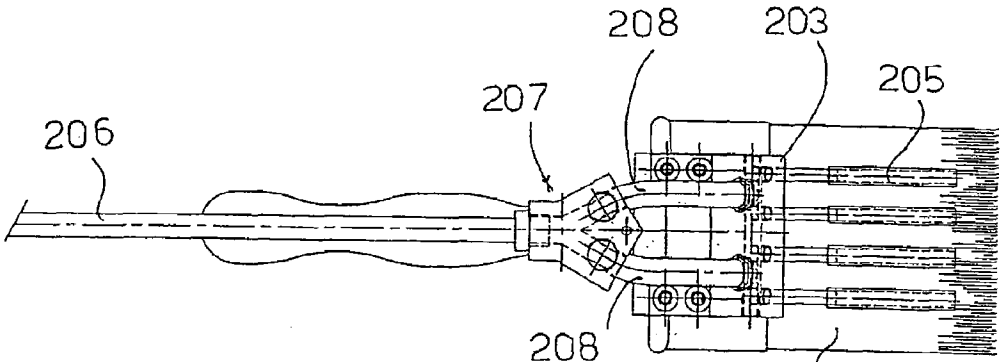
Figure 13A:
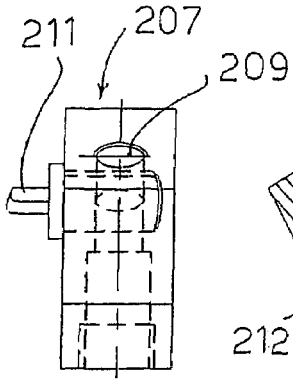
Figure 13B:
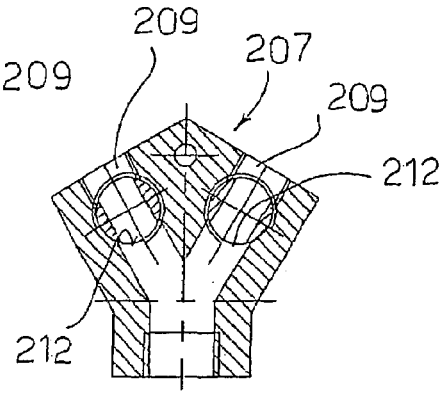
Figure 13C:
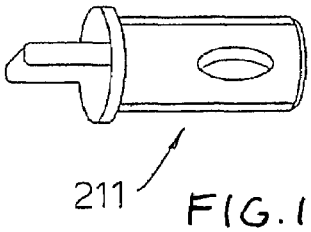
Figure 14:
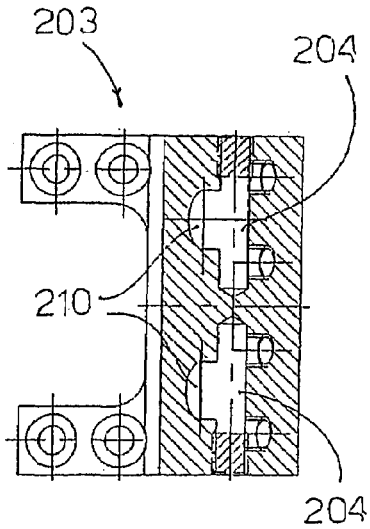
Figure 15A:
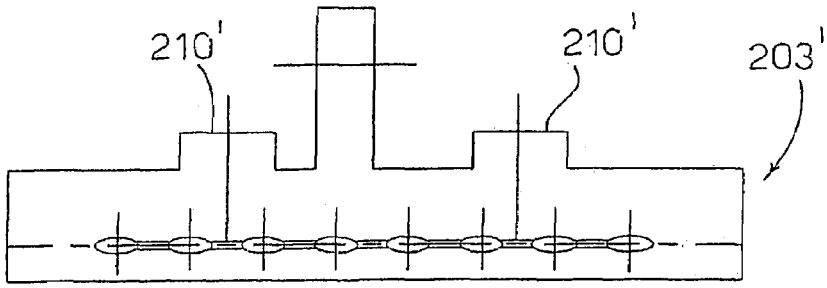
Figure 15B:
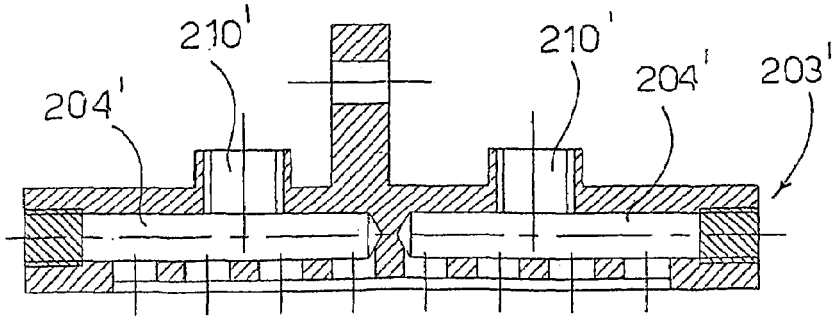
Figure 16B:
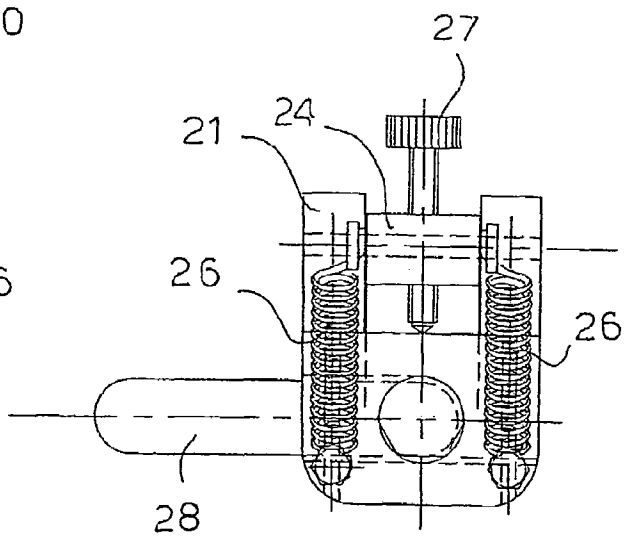
Figure 16C:
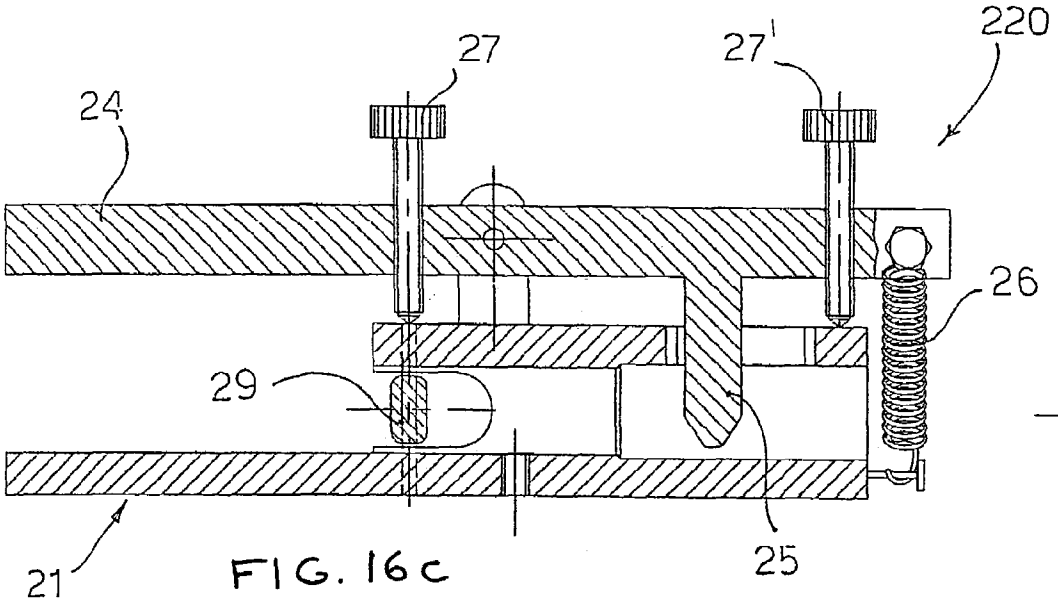
Figure 16A:
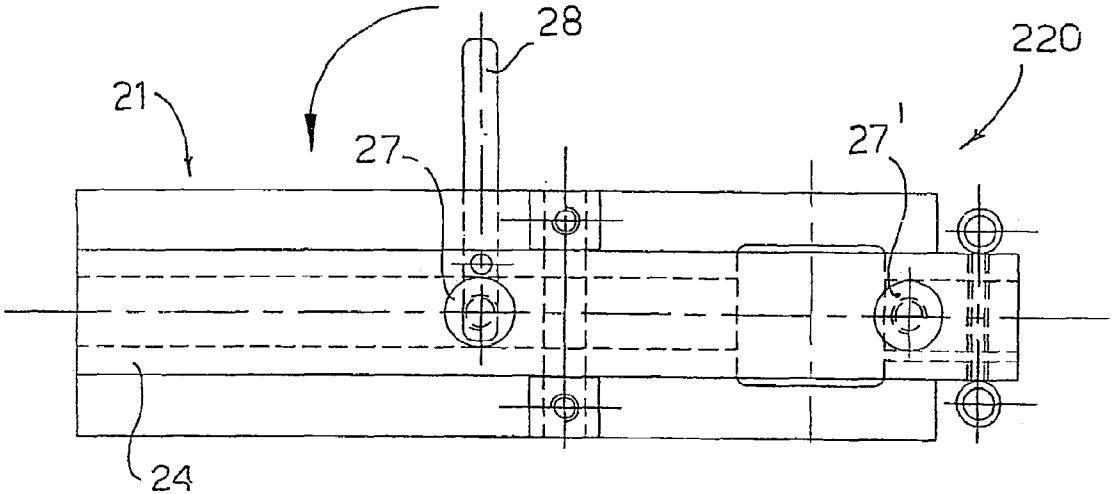
Figure 17B:
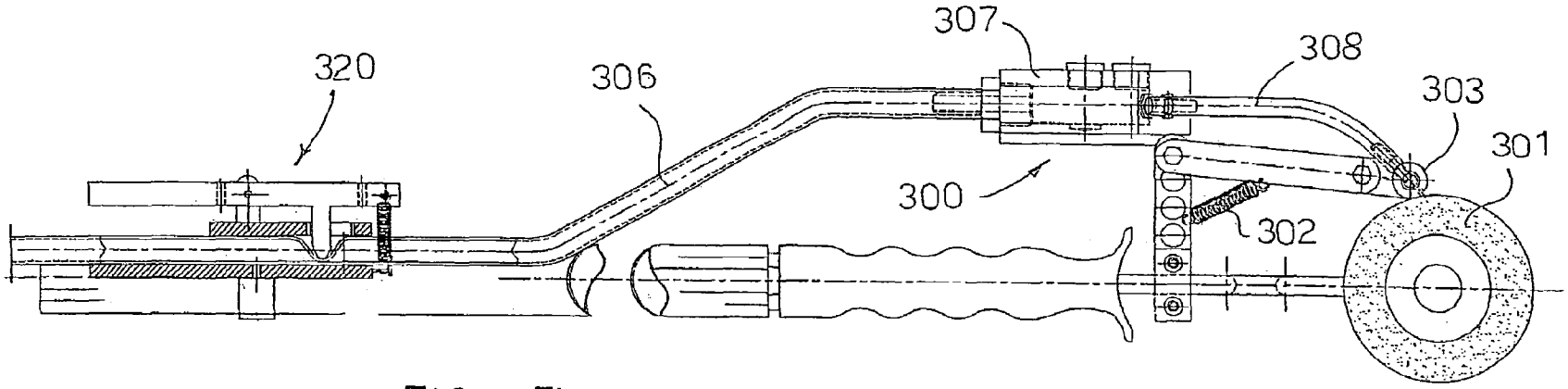
Figure 17A:
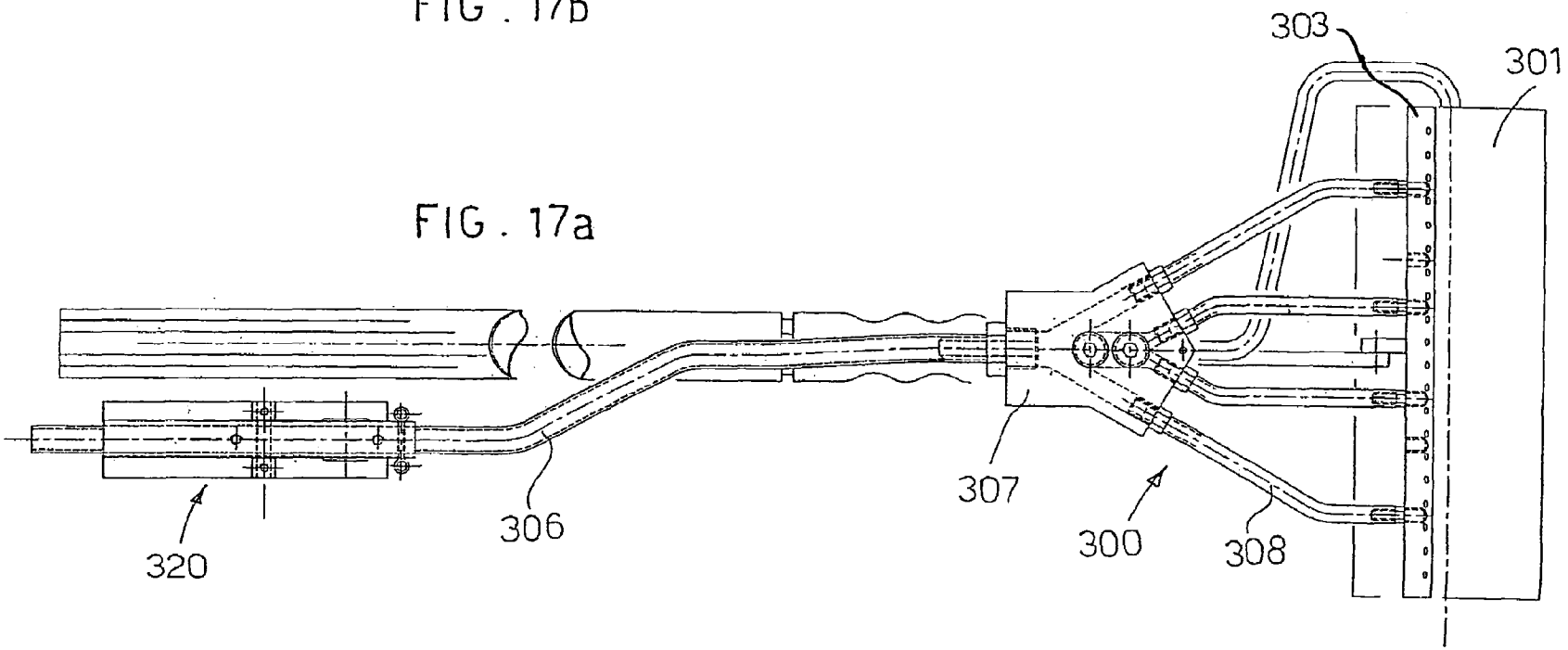
Figure 18B:
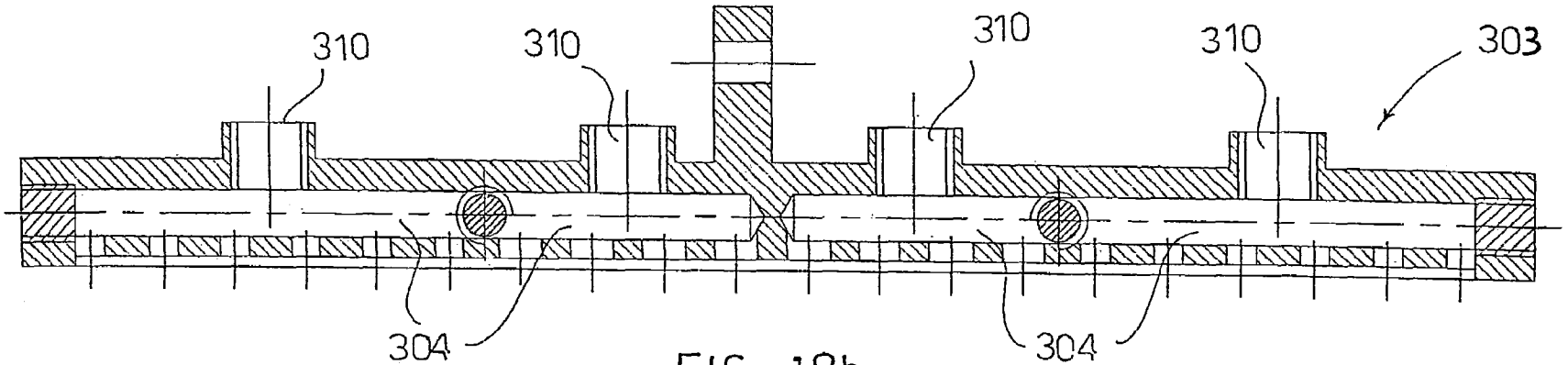
Figure 18A:
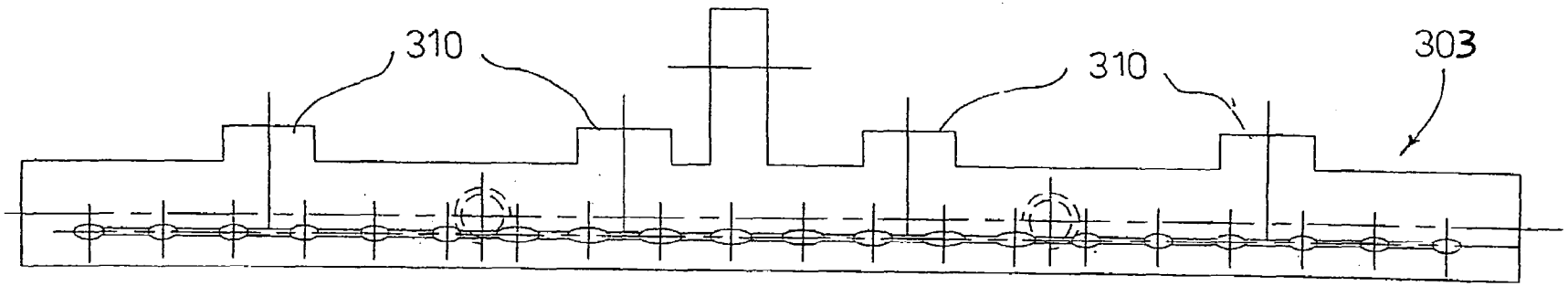
Figure 19A:
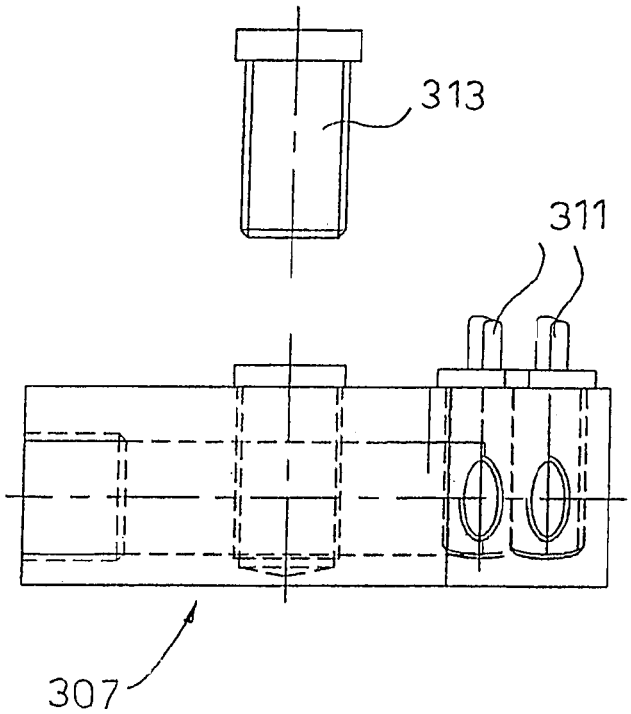
Figure 19C:
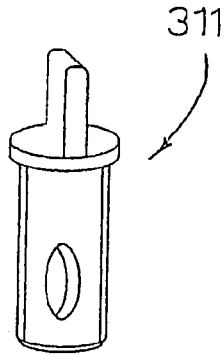
Figure 19B:
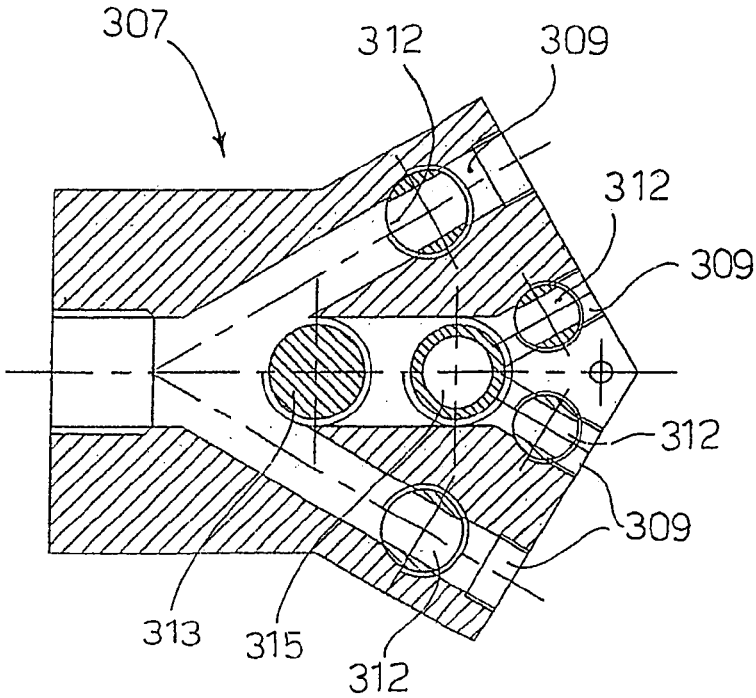
Figure 21B:
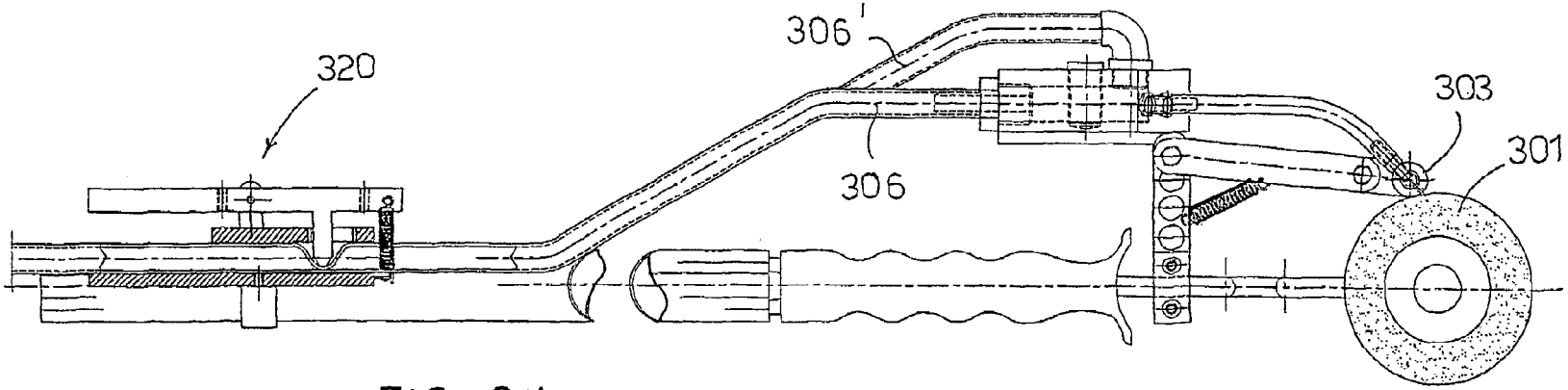
Figure 21A:
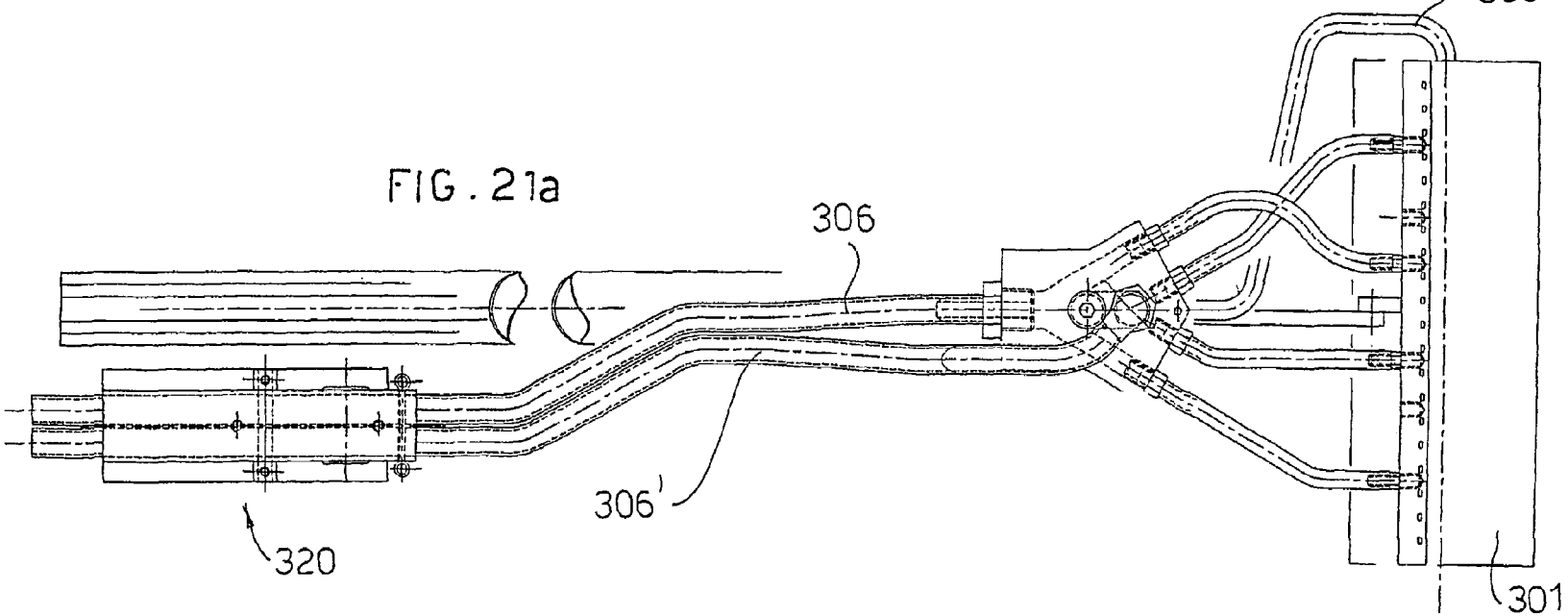
Figure 22B:
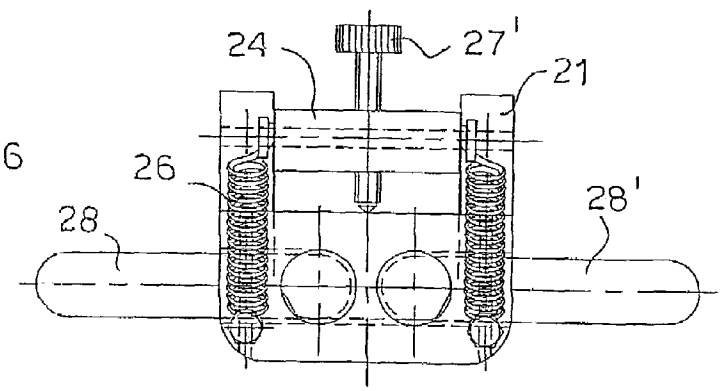
Figure 22C:
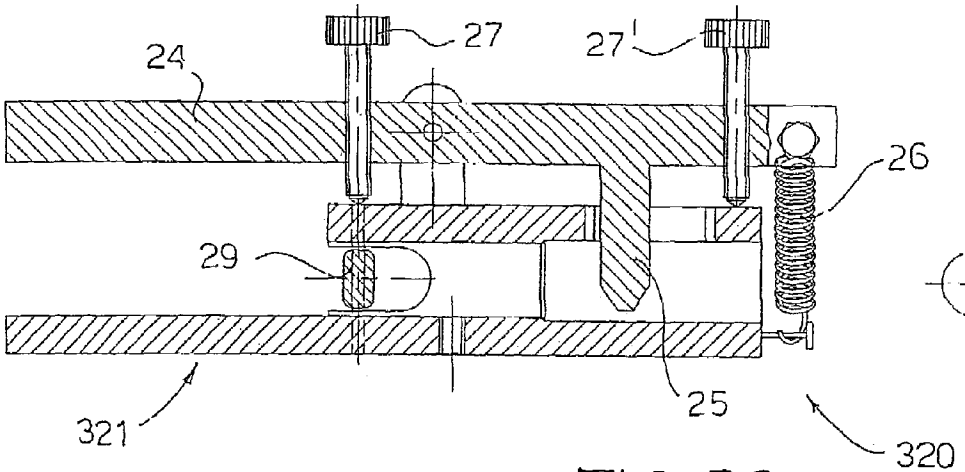
Figure 22A:
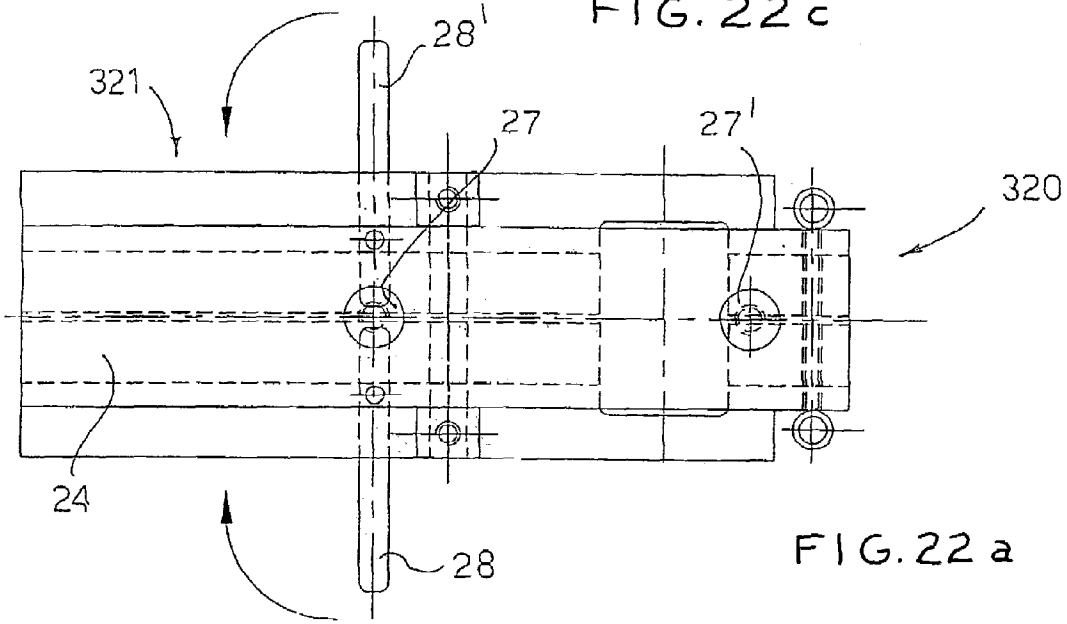
Figure 23B:
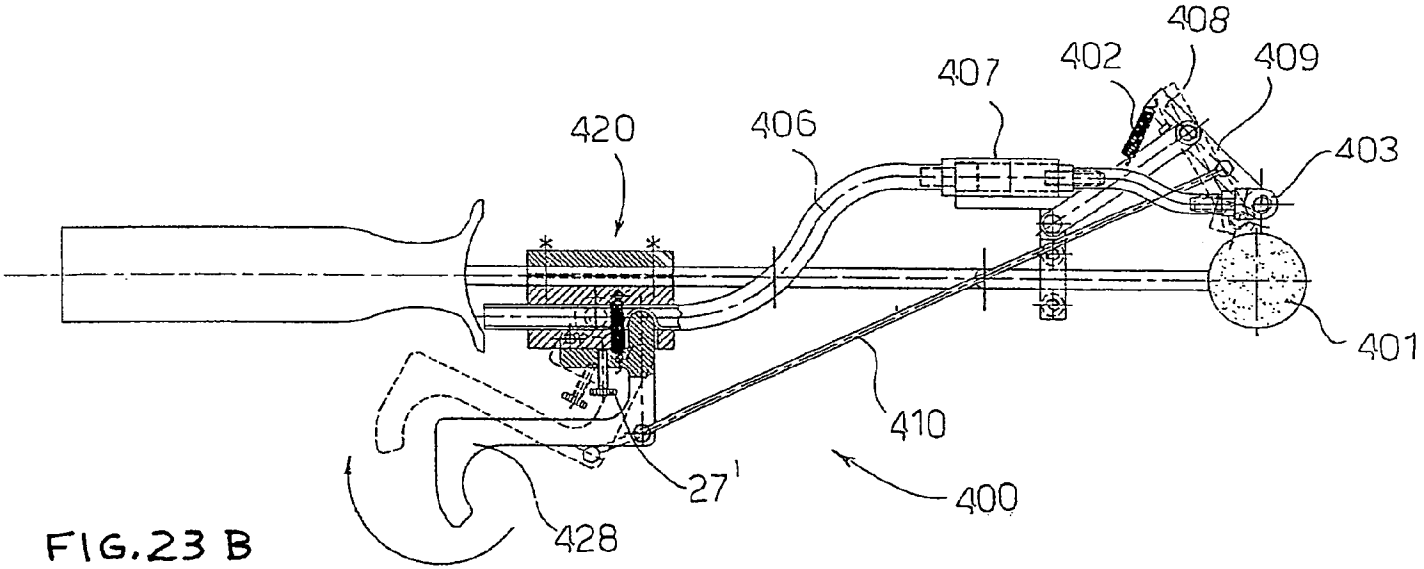
Figure 23A:
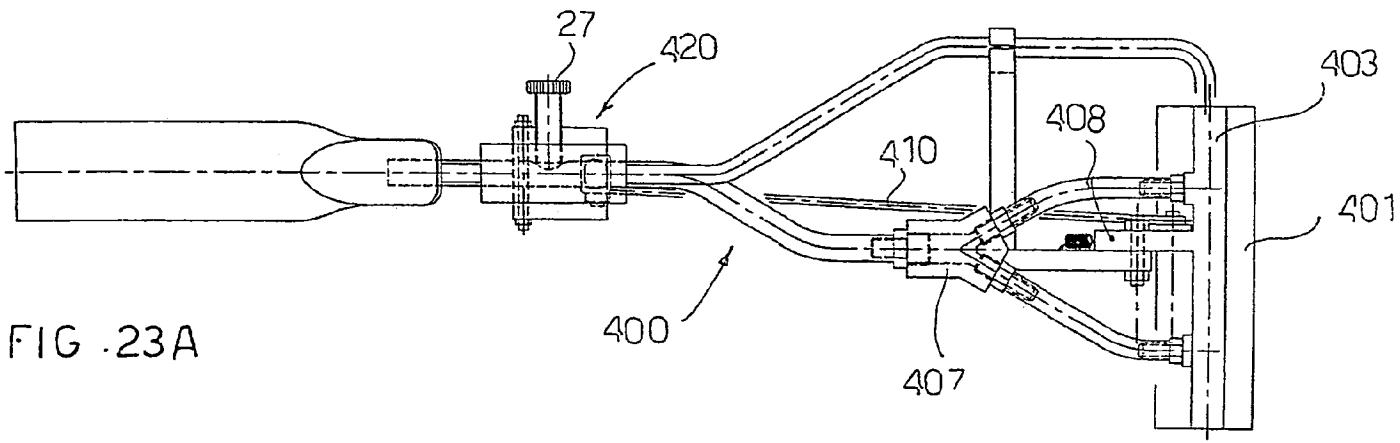
Figure 24B:
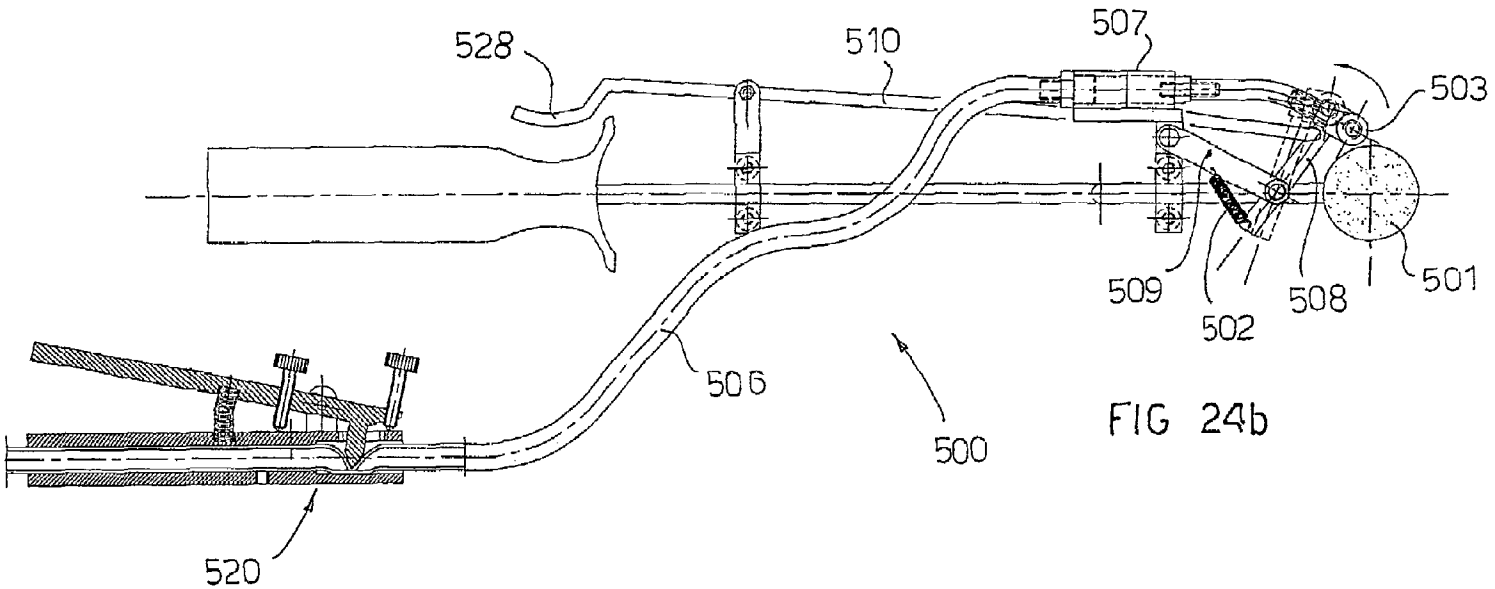
Figure 24A:
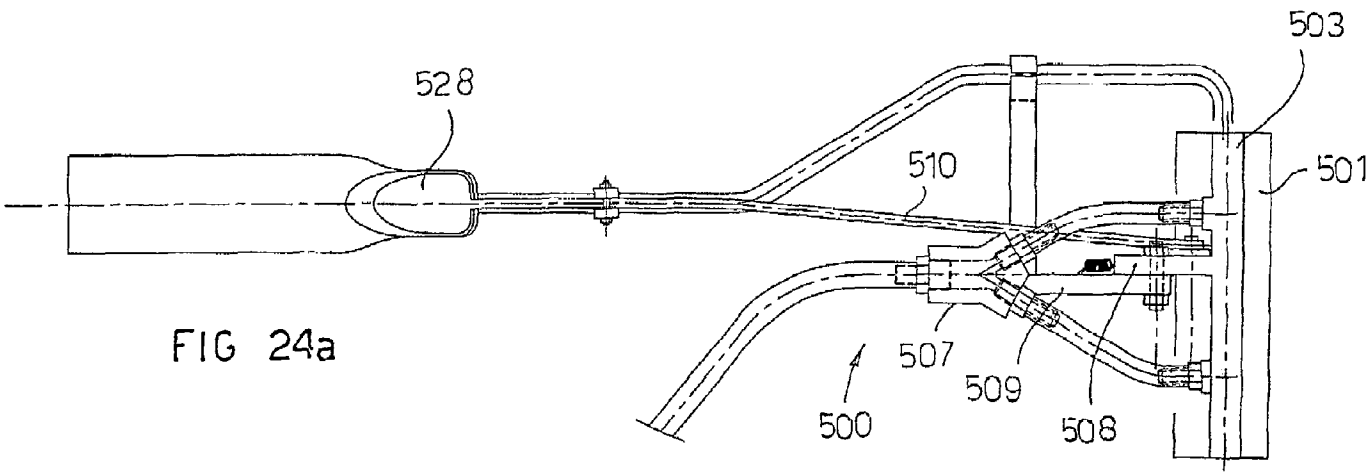
Figure 25B:
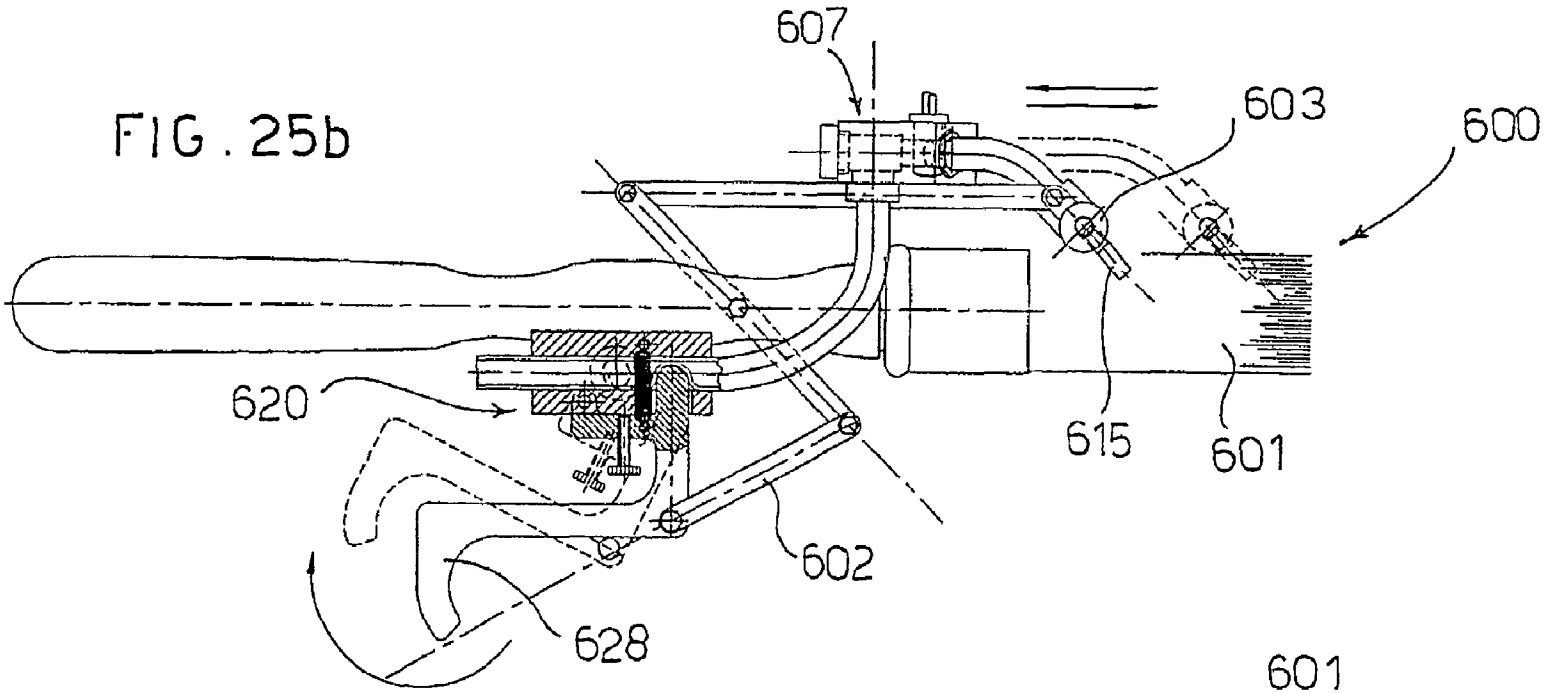
Figure 25A:
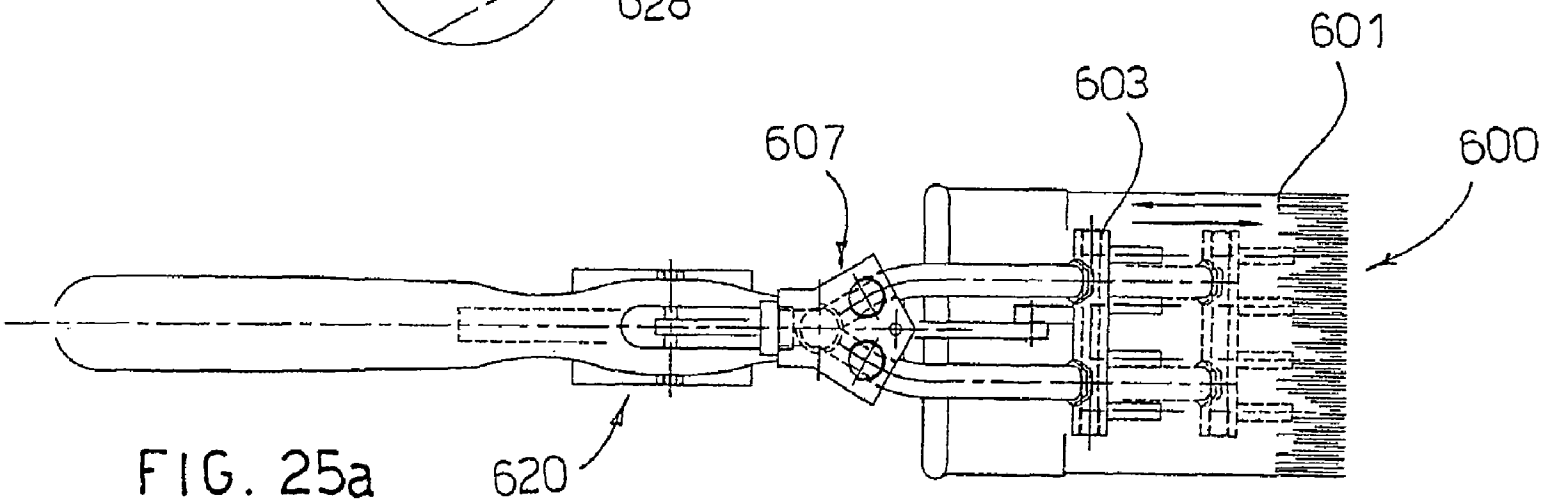

FIGS. 12*a* and 12*b* are a top view and a side view, respectively, of a painting device (brush with short handle) providing a second embodiment of an applier in accordance with the invention;

FIGS. 13*a* and 13*b* are a side view and a sectional top view, respectively, of the distribution device of the applier of FIG.12;

FIG. 13*c*is a perspective view of a valve body in the distribution device of FIGS. 13*a* and 13*b*;

FIG. 14 is a sectional view of the manifold of FIG. 12;

FIGS. 15*a* and 15*b* are a bottom view and a sectional side view, respectively, of a manifold to be used with a roller type painting device providing the applier of FIG. 12;

FIGS. 16*a* and 16*b* are a top view, a front view and a sectional side view, respectively, of the flow adjusting means of FIG. 12;

FIGS. 17*a* and 17*b* are a top view and a side view, respectively, of a painting device (a roller) providing a third embodiment of an applier in accordance with the invention;

FIGS. 18*a* and 18*b* are a bottom view and a sectional side view, respectively, of the manifold of FIG. 17;

FIGS. 19*a* and 19*b* are side view and a sectional top view, respectively, of the distribution device of the applier of FIG. 17;

FIG. 19*c* is a perspective view of a valve body in the distribution device of FIGS. 19*a* and 19*b*;

FIGS. 20*a* and 20*b* are a further side view and sectional view, respectively, of the distribution device of FIG. 19;

FIGS. 21*a* and 21*b* are a top view and a side view, respectively, of the painting device of FIG. 17 providing two supply ducts;

FIGS. 22*a*, 22*b* and 22*c* are a top views a front view and a sectional side views respectively, of the flow adjusting means of FIGS. 21*a* and 21*b*;

FIGS. 23*a* and 23*b* are a top view and a side view respectively, of a painting device (a roller) providing a fourth embodiment of an applier in accordance with the invention;

FIGS. 23A and 23B are a top view and a side view, respectively, of an alternative embodiment of the applier of FIGS. 23*a* and 23*b*;

FIGS. 24*a* and 24*b* are a top view and a side view, respectively, of a painting device (a roller) providing a fifth embodiment of an applier in accordance with the invention;

FIGS. 25*a* and 25*b* are a top view and a side view, respectively, of a painting device (a short handle brush) providing a sixth embodiment of an applier in accordance with the invention.

Figure 26:
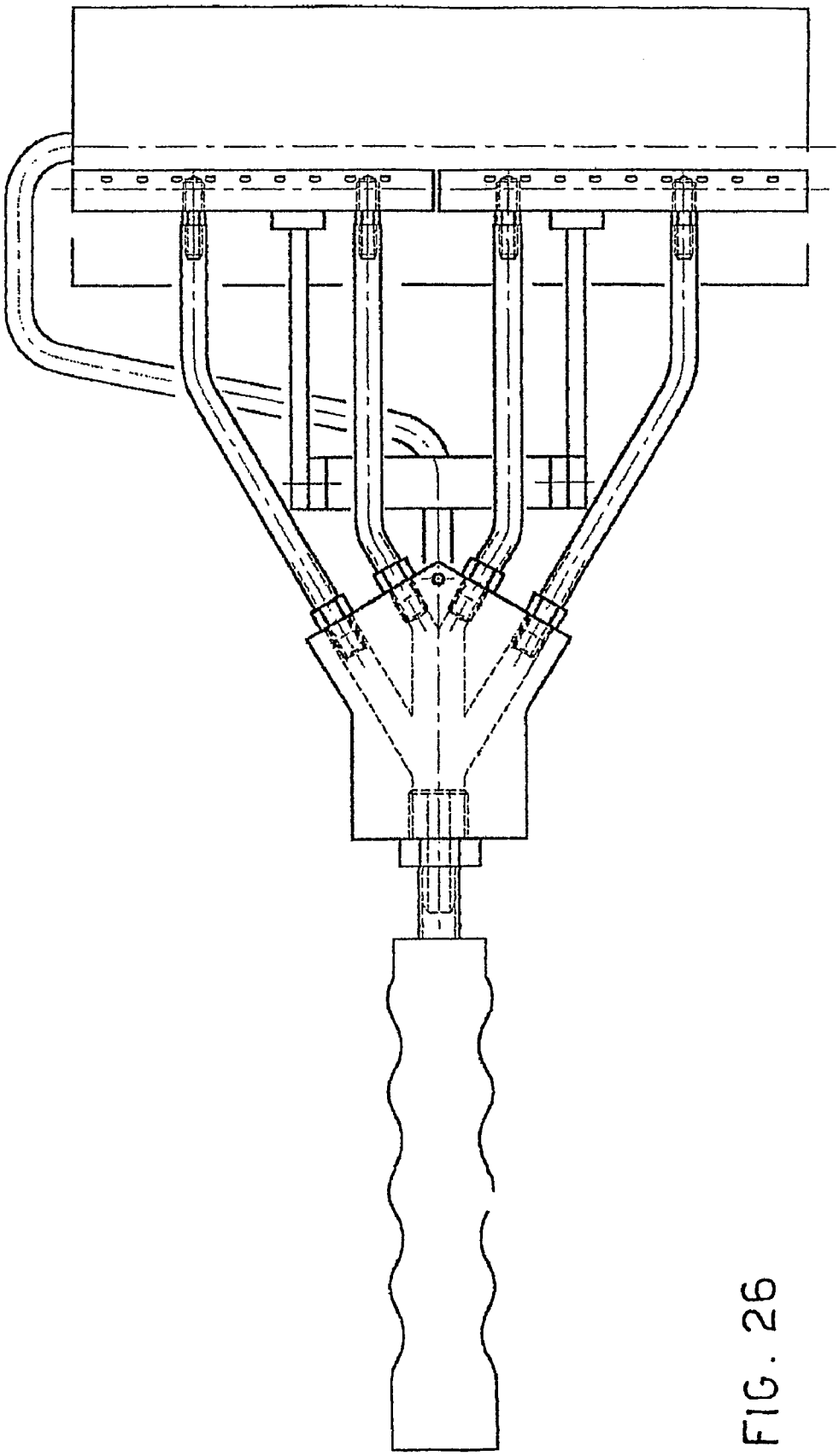

FIG. 26 is a very schematic top view of a roller type painting device providing for a seventh embodiment of an applier in accordance with the invention.

Figure 1:
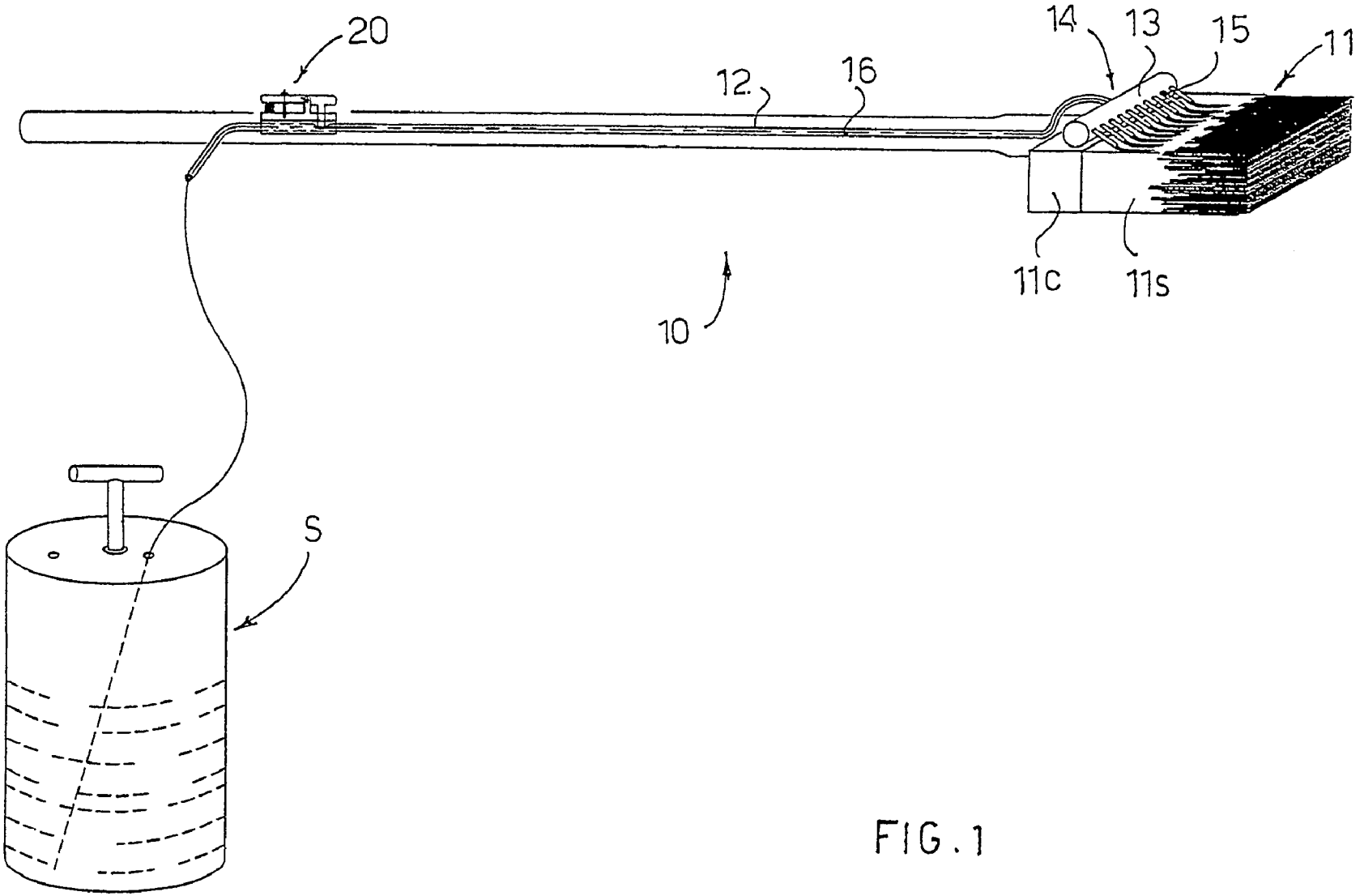
Figure 1A:
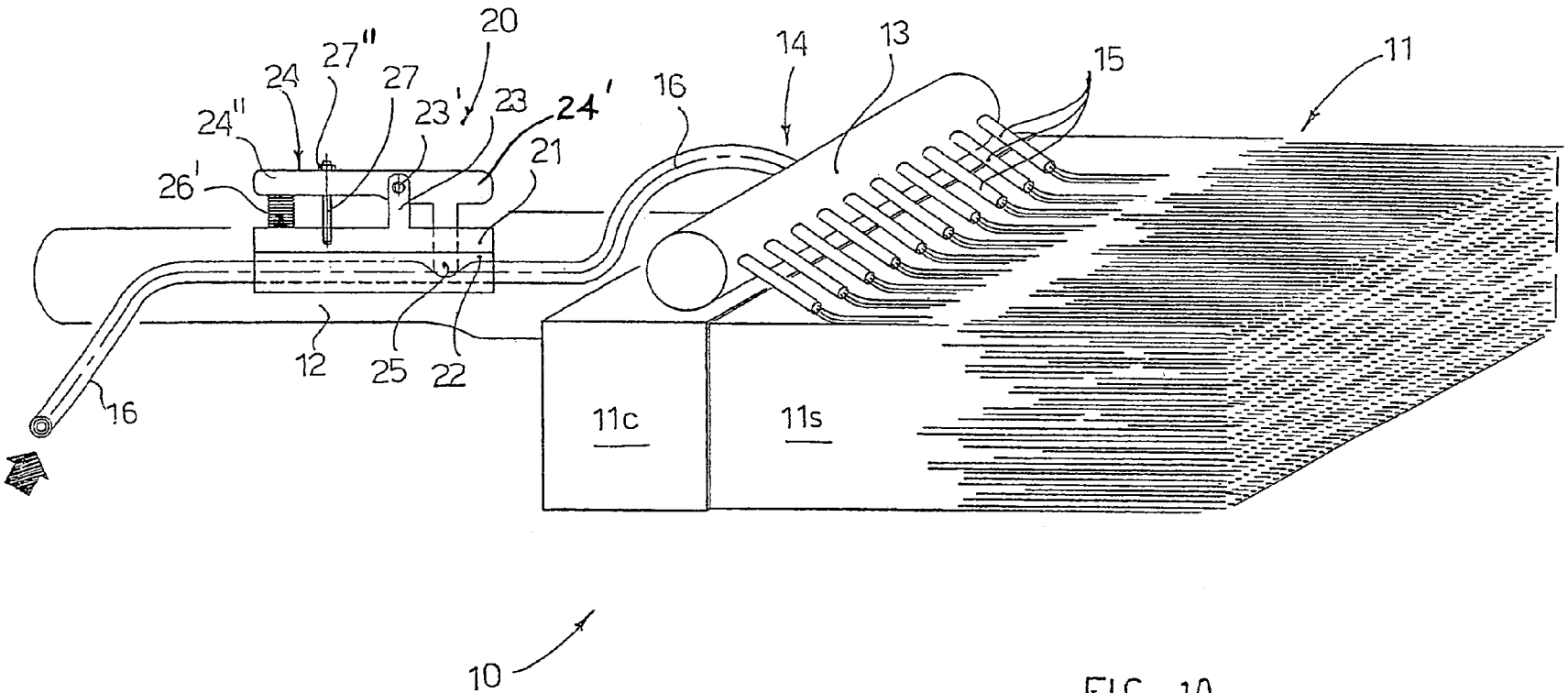

With reference first all to FIGS. 1 and 1*a*, the painting device shown in these is a long-handle brush in 1 and a short-handle brush in 1*a*, the parts of which, apart from the handle, are identical. Just one description will therefore be given and the same reference will be used for both. The device is generally indicated by reference 10 and comprises a brush head 11, a long stem or handle 12. The head 11 includes a bristle part 11*s* and a rib part 11*c*. On rib 11*c* is applied and/or made integral a manifold 13 of an applier for paint or varnish, generally indicated by 14. The manifold is hollow inside and from it extend towards the bristles several distribution channels 15 in fluid communication with it and open at their respective distal ends. The manifold 13 is in fluid communication with a supply duct 16 outside the handle 12. The duct 16 is normally a flexible hose. The end upstream of the supply duct 16 is supplied by a tank S of paint or varnish, which preferably has an internal pressure slightly above that of the atmosphere, for instance a pressure between 1 and 1.5 bar. These containers or tanks are easy to find on the market and so no detailed explanation will be given.

To regulate the supply of paint, the invention provides flow adjusting means θor register device generally indicated with reference 20, which will be described in detail with reference to FIG. 1*a*. Flow adjusting means 20 comprise a substantially tubular body 21, which defines internally a chamber 22 for pipe 16, open at the ends. From the body extends an arm 23; on the arm 23 is hinged in 23' a lever 24, which provides on one end of one side 24' a shutter 25. The shutter 25 extends, through an opening in the body 21, into the internal chamber 22 defined by said body. On the other side 24" of the lever a pressing spring 26' acts borne on the body 21. The pressing force applied by the spring acts so as to push the shutter 25 and cause this to penetrate more into the chamber body. An adjusting screw 27 is fastened with its end inside the body 21, so as to represent a substantial extension of this protruding from the body. The side 24" of the lever accommodates in a sliding way the stem of the screw 27 and a nut 27" screwed onto the stem represents a limit for the position of the side 24" in the oscillation hose 16 so as to accommodate a piece of this in chamber 22. Depending on the position it takes, the shutter 25 crushes the pipe more or less and thus adjusts the flow. By pressing on the branch 24" of lever 24, the operator can easily more or less open the pipe opening to allow more or less paint to flow through.

Figure 2:
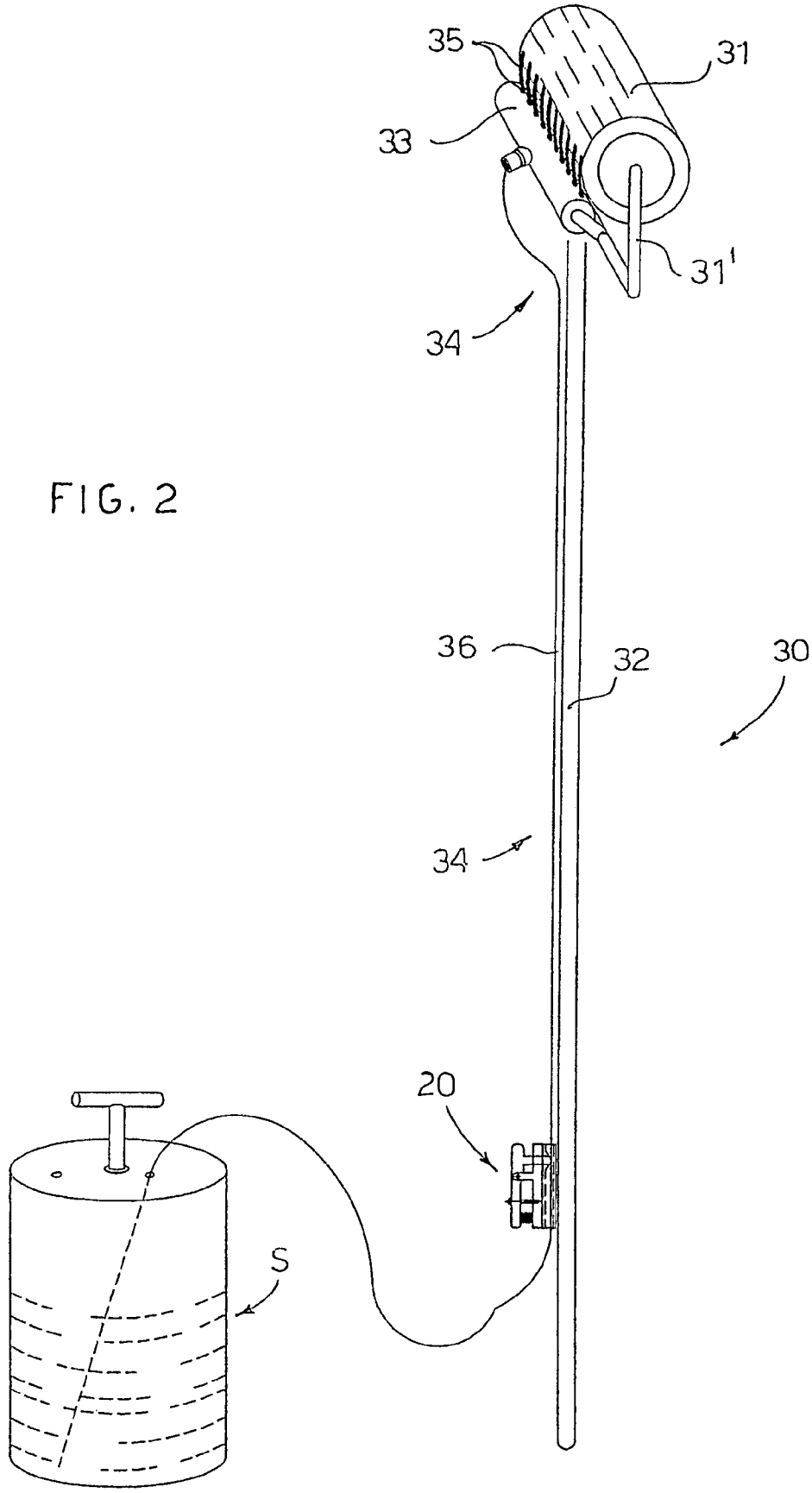
FIG. 2 is an axonometric view of a second painting device according to the invention.

A second embodiment of the invention is shown in FIG. 2 and is generally indicated by reference 30 and comprises a roller head 31, a long stem or handle 32. The head 31 generally consists of a traditional roller, swivelling supported on a frame 31' of the roller. To frame 31' is fitted and/or made integral a manifold 33 of an applier for paint or varnish, 34. The manifold is completely hollow and provides distribution openings 35 near the roller and is connected in fluid communication with a flexible supply hose 36, applied outside or inside the handle 32. The upstream end of the supply pipe 36 is supplied by a tank S of varnish or paint, in the same way as described for the first embodiment. In this case as well a register 20 has been illustrated like that previously described.

Figure 3:
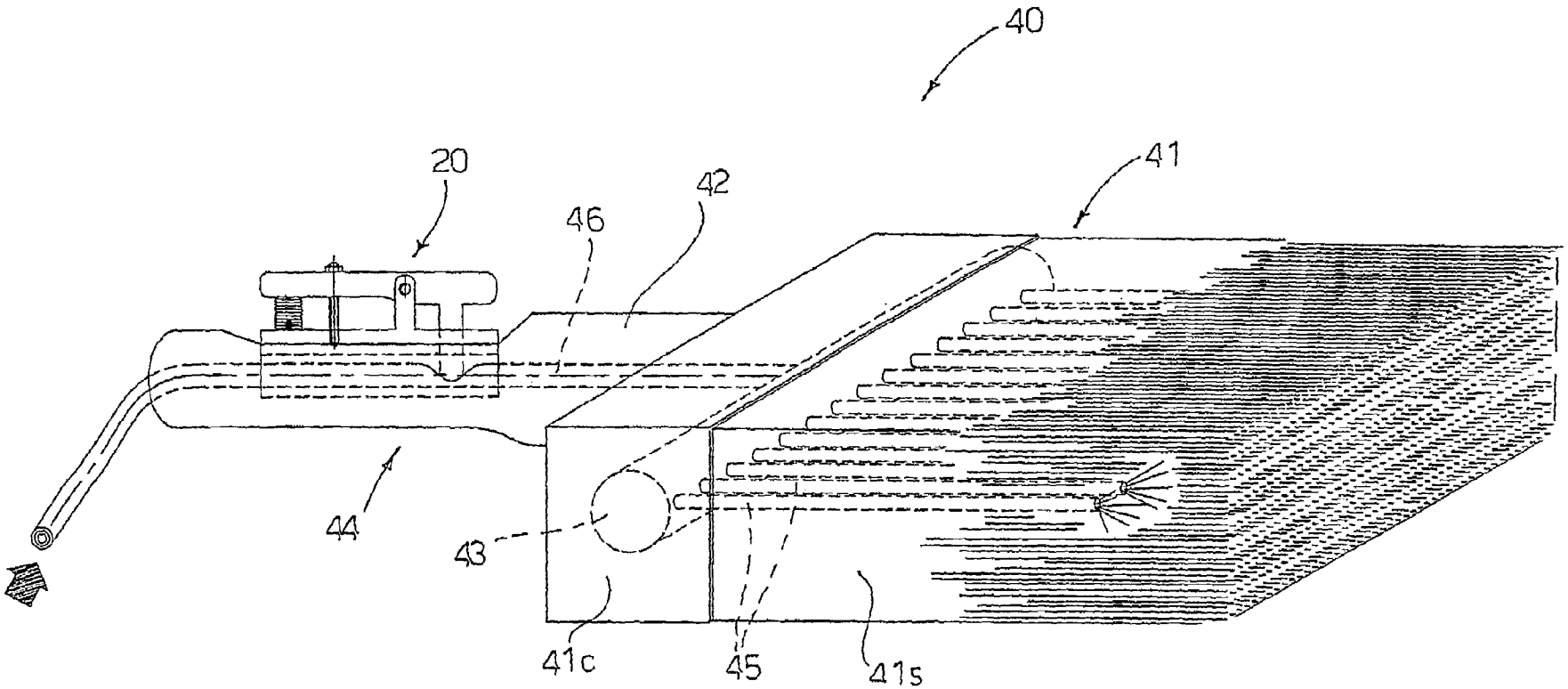
FIG. 3 is an axonometric view of a third embodiment.

The embodiment 40 of FIG. 3 is substantially a brush the bristle head 41 of which comprises a rib 41*c* and bristles 41*s*. The manifold 43 is located inside the rib 41*c* and the small channels 45 extend between the bristles for a part of the same length as the bristles. Reference 46 refers to the flexible supply hose, which runs inside the handle 42 and appears with an intermediate length where there is a slot in the handle, where the previously described adjusting flow adjusting means 20 is fitted. The manifold 43, the pipe 46 and the flow adjusting means 20 make up the applier. The embodiment just referred to ensures excellent distribution of the paint at the working ends of the bristles.

Figure 4:
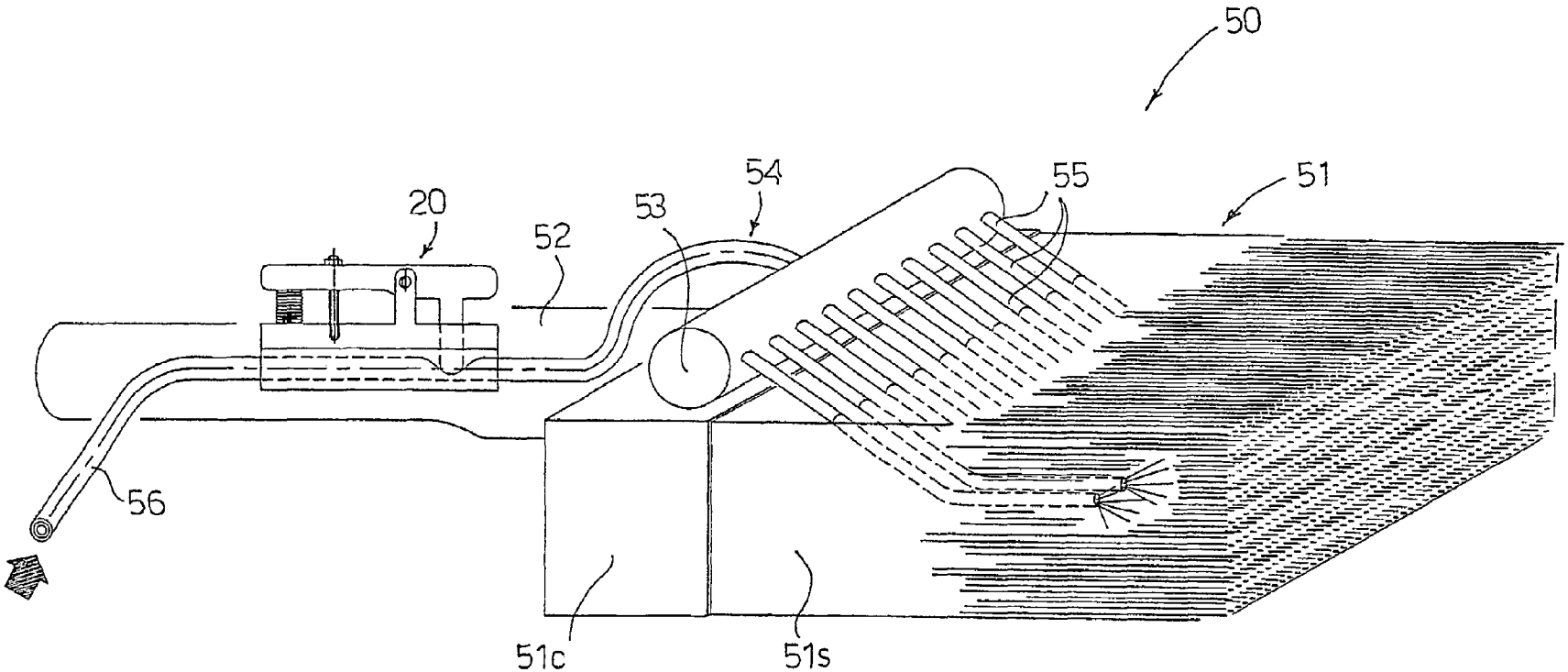
FIG. 4 is an axonometric view of a fourth embodiment of the painting device.

The device 50 shown in FIG. 4 is also a brush device, with head 51 consisting of a rib 51*c* and bristles 51*s*. In this case the manifold 53 of applier 54 is outside the rib 51*c* and is integral with this with any known means, and the small feeding channels 55 have an angled shape to as to be able to be inserted amid the bristles and supply the paint amid the bristles. The supply duct 56 is fitted outside or inside the handle 52 and on this flow adjusting means 20 is fitted.

Figure 5:
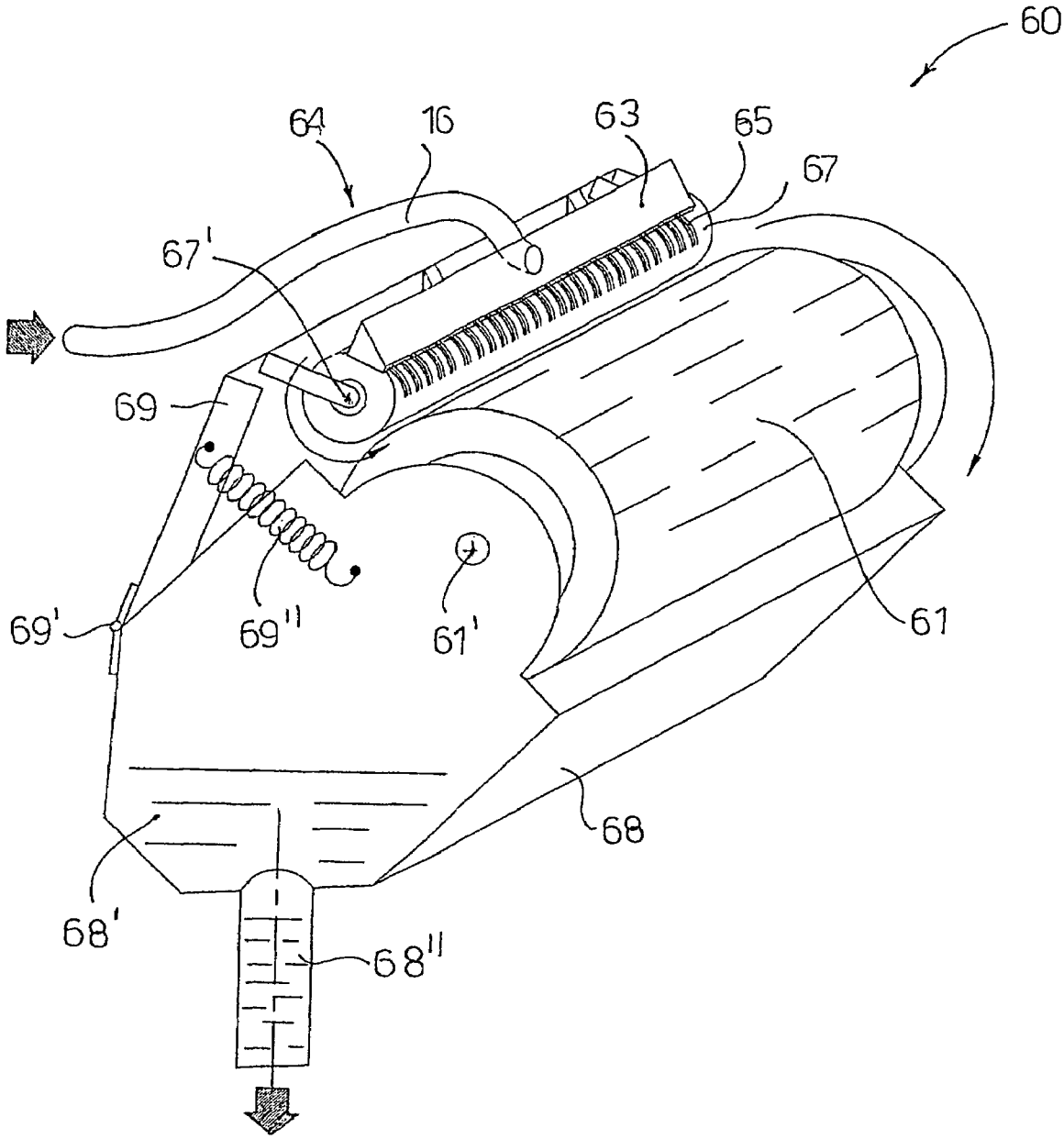
FIG. 5 is an axonometric view of a fifth embodiment.

FIG. 5 shows another embodiment of the device, indicated by 60. The device 60 comprises a roller 61 that swivels around an axis 61', curried by a frame 68 formed by a collection tray part 68', for collecting up excess paint. The tray part provides a drain pipe 68" for conveying the excess paint collected in the tray to a container for any recycling. A wall 69 of the frame is connected by hinge in 69' to the tray part, towards which it is returned by a spring 69" on each side. The wall 69 provides a homogeniser roller 67, idle around an axis 67' parallel to axis 61'. The manifold 63 of the applier 64 providing dispensing holes 65, dispenses onto the roller 67 and this in turn applies the paint to roller 61, against which it is pressed by springs 69".

Figure 6:
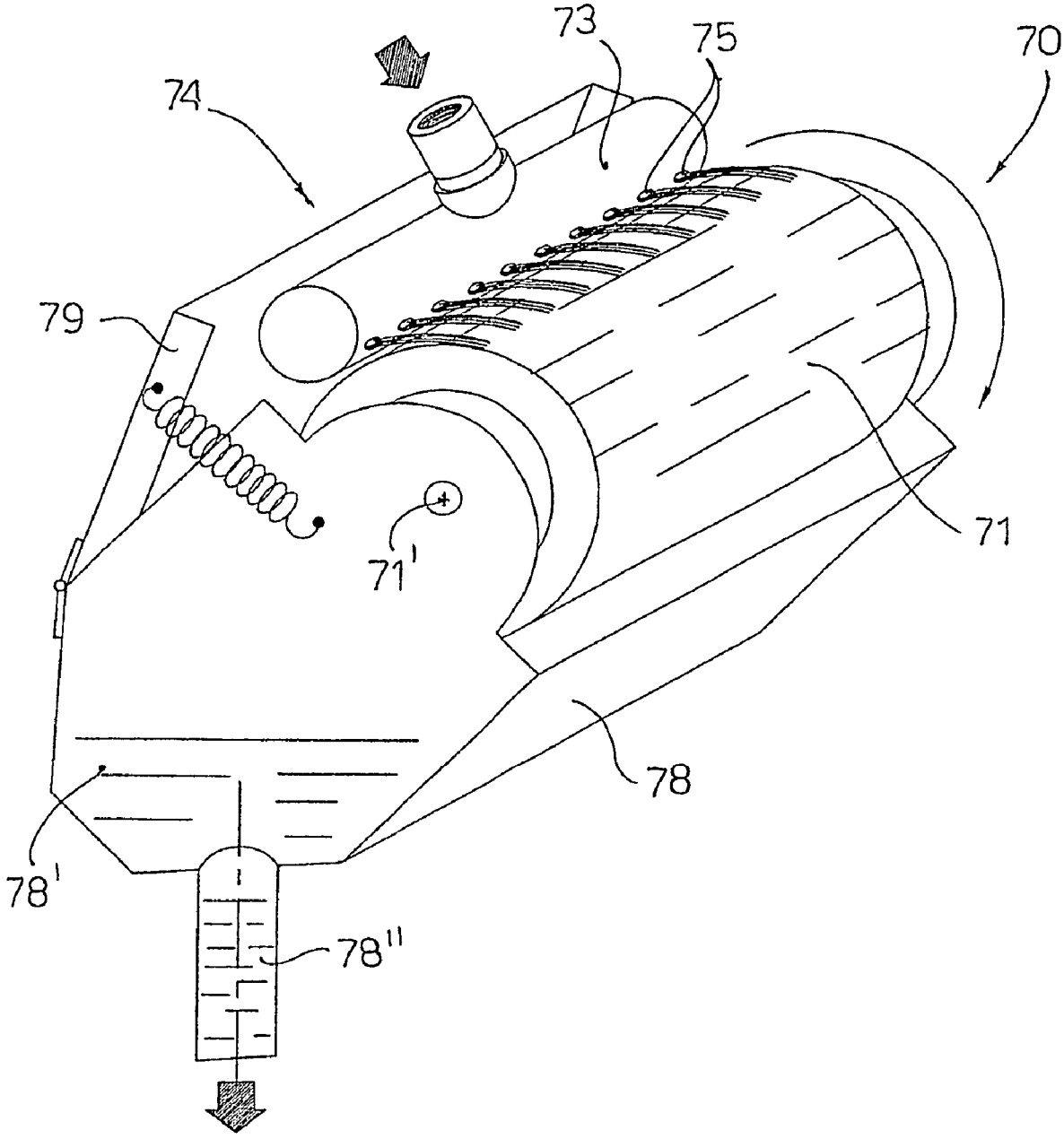
FIG. 6 is an axonometric view of a sixth embodiment of the painting device with applier.

The embodiment 70 shown in FIG. 6 is similar to the previous one inasmuch as it also comprises a painting roller 71 swivelling around an axis 71' curried by a frame 78 with collection tray part, 78', and drain pipe 78". In this case on the hinged wall returned by spring a manifold pipe 73 is fitted with dispensing holes 75 that dispense directly onto the applier roller 71. The manifold 73 of the applier 74 is supplied in the same way as in the case of the other embodiments and consequently it has not been considered necessary to draw the flexible hose and other parts.

Figure 7:
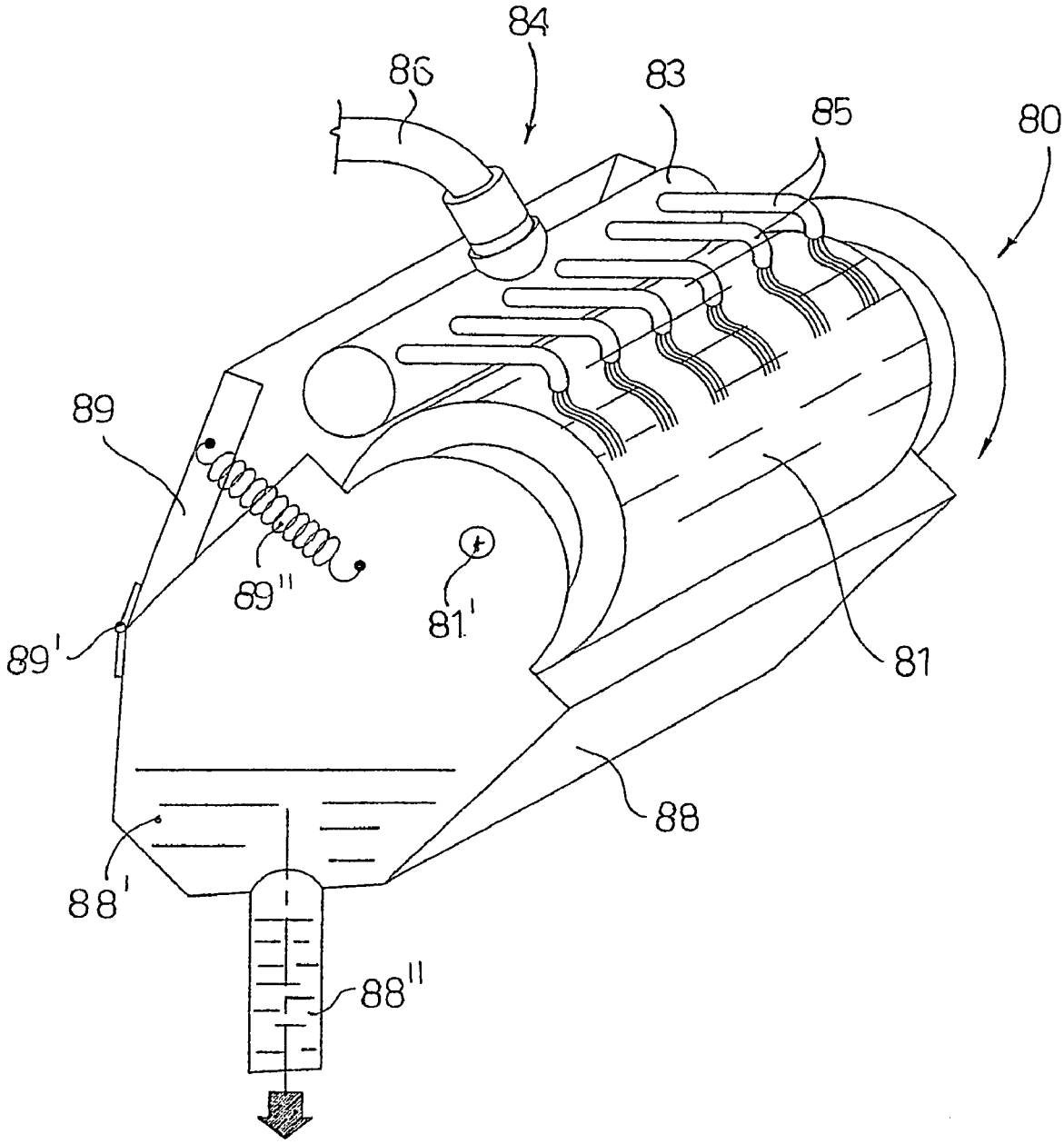
FIG. 7 is an axonometric view of a seventh embodiment.

Embodiment 80 in FIG. 7 comprises an applier roller 81 idle supported on axis 81' curried by frame 88. The frame 88 has the shape of tray 88' as described above with reference to other embodiments, and the hinged wall 89 of the frame, recalled by springs 89", bears a manifold 83 providing small distribution channels 85 that dispense onto roller 81. The manifold 83 of applier 84 is supplied by flexible hose 86.

Figure 8:
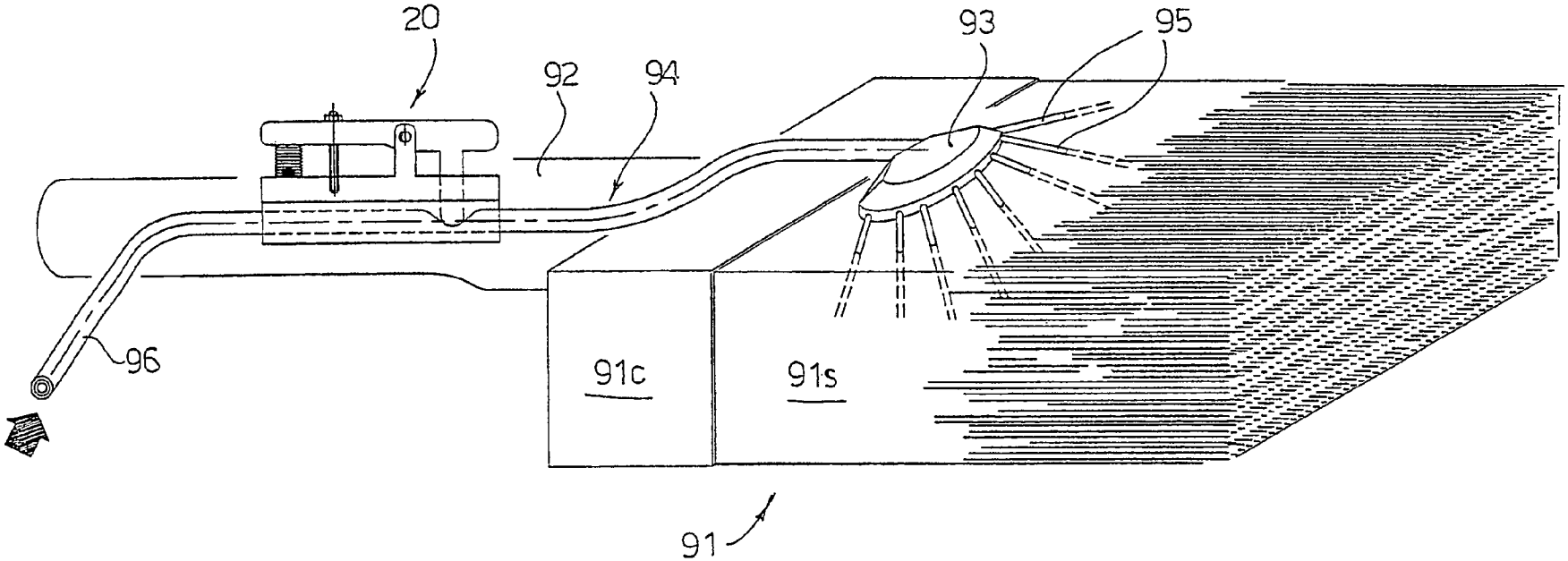
FIG. 8 is an axonometric view of an eighth embodiment of the painting device.

Embodiment 90 of FIG. 8 comprises a brush head, the applier 94 of which comprises a manifold 93 having dispensing channels 95 arranged radially with respect to a centre of the manifold. The radially dispensing manifold can be inside or outside the bristle head and fitted to this in any way whatsoever.

Figure 9:
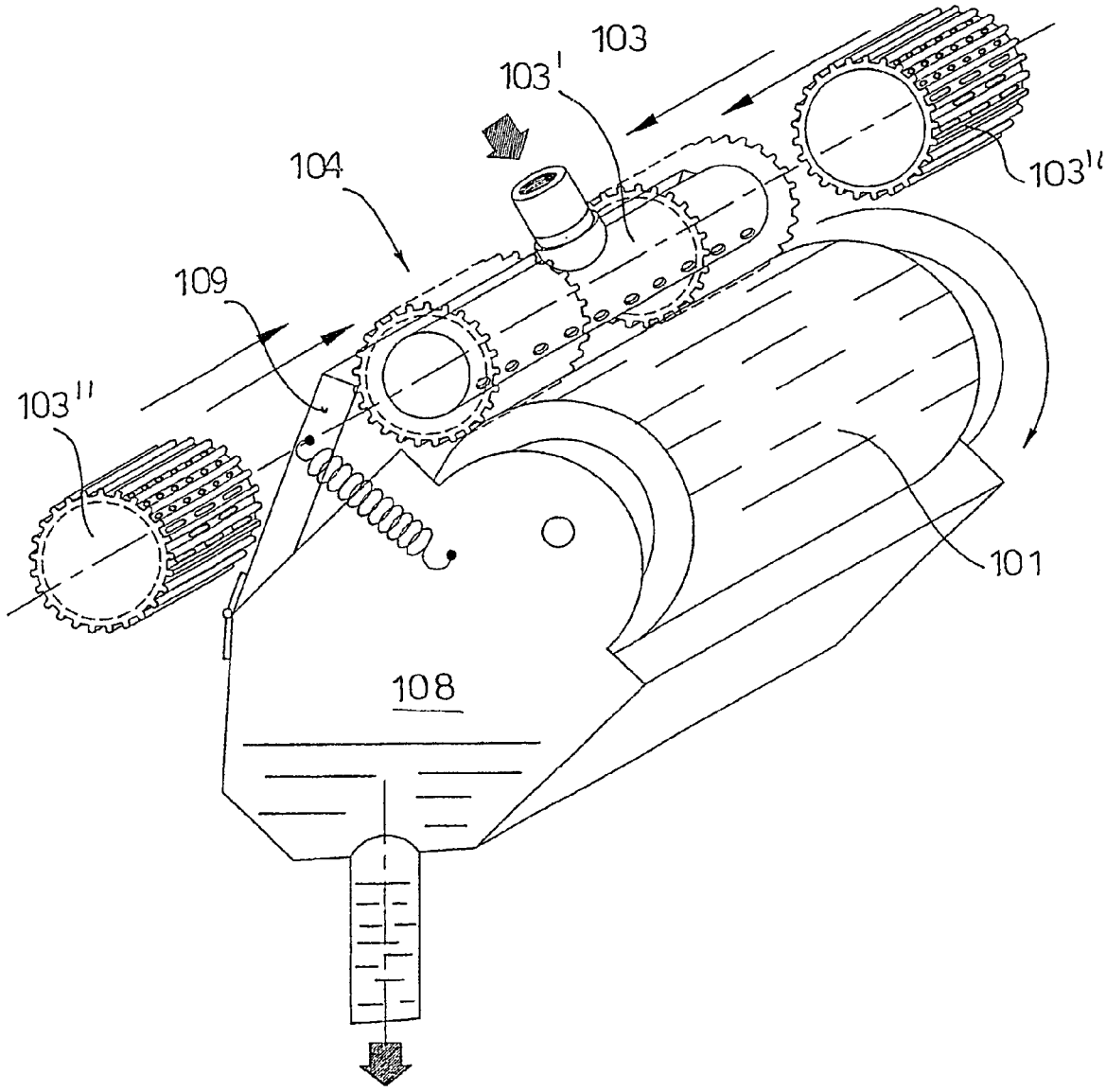
FIG. 9 is an exploded axonometric view of the ninth embodiment.

The embodiment 100 in FIG. 9 comprises an applier roller 101 and a box 108 as explained above with reference, for instance, to FIG. 5. In this case, the manifold 103, shown exploded, (of applier 104) comprises an internal manifold body 103', perforated, and distribution cylinders 103" around this, providing holes of various sizes and configurations and in various positions along the circumference. The manifold with the cylinders is brought onto the hinged wall 109 of the roller-holder frame and elastically pressed against the roller.

Figure 10:
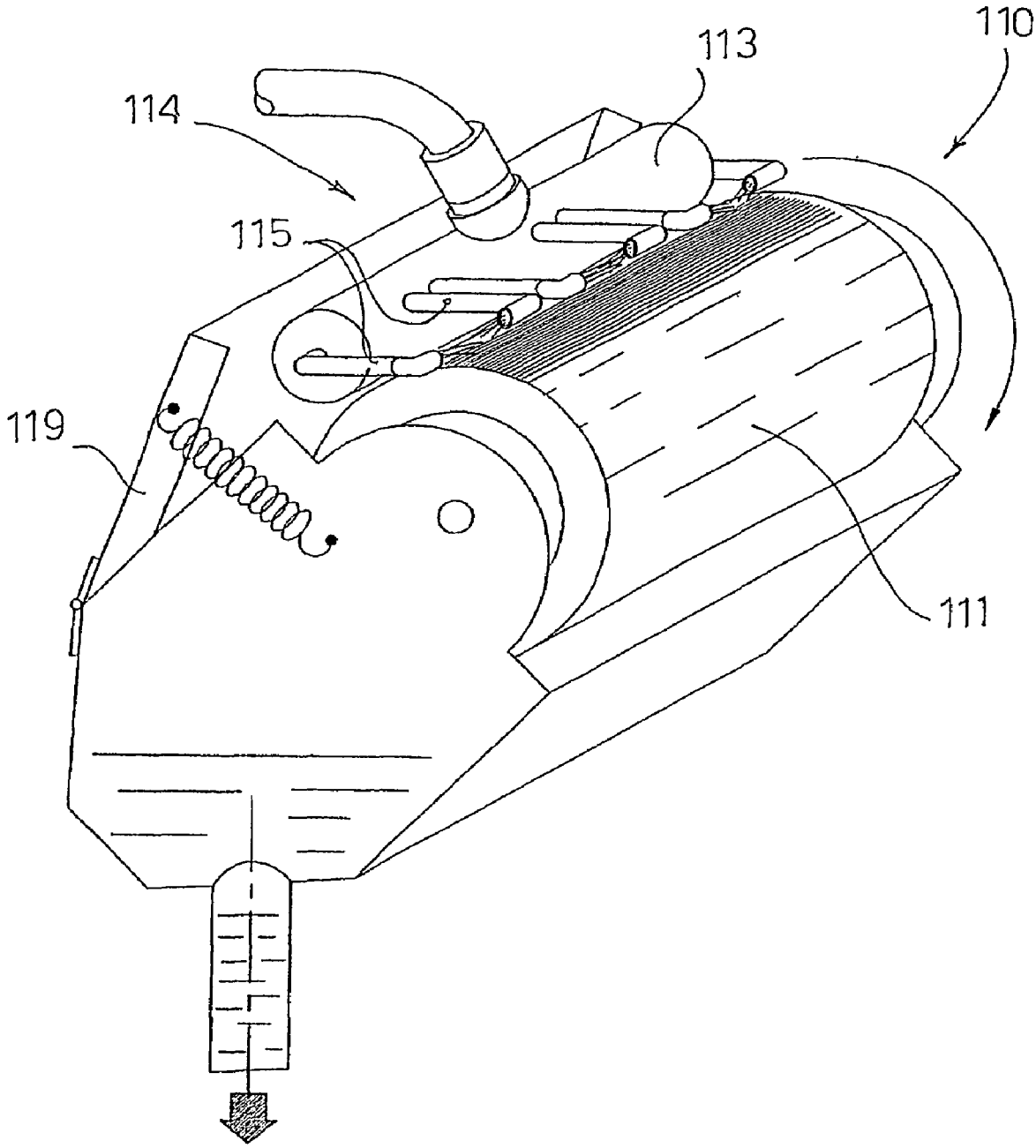
FIG. 10 shows an axonometric view of the tenth embodiment.

FIG. 10 shows embodiment 110 with applier roller 111. The manifold 113 of applier 114 brought by the hinged wall 119, comprises L-layout dispensing channels arranged facing each other two by two.

Figure 11:
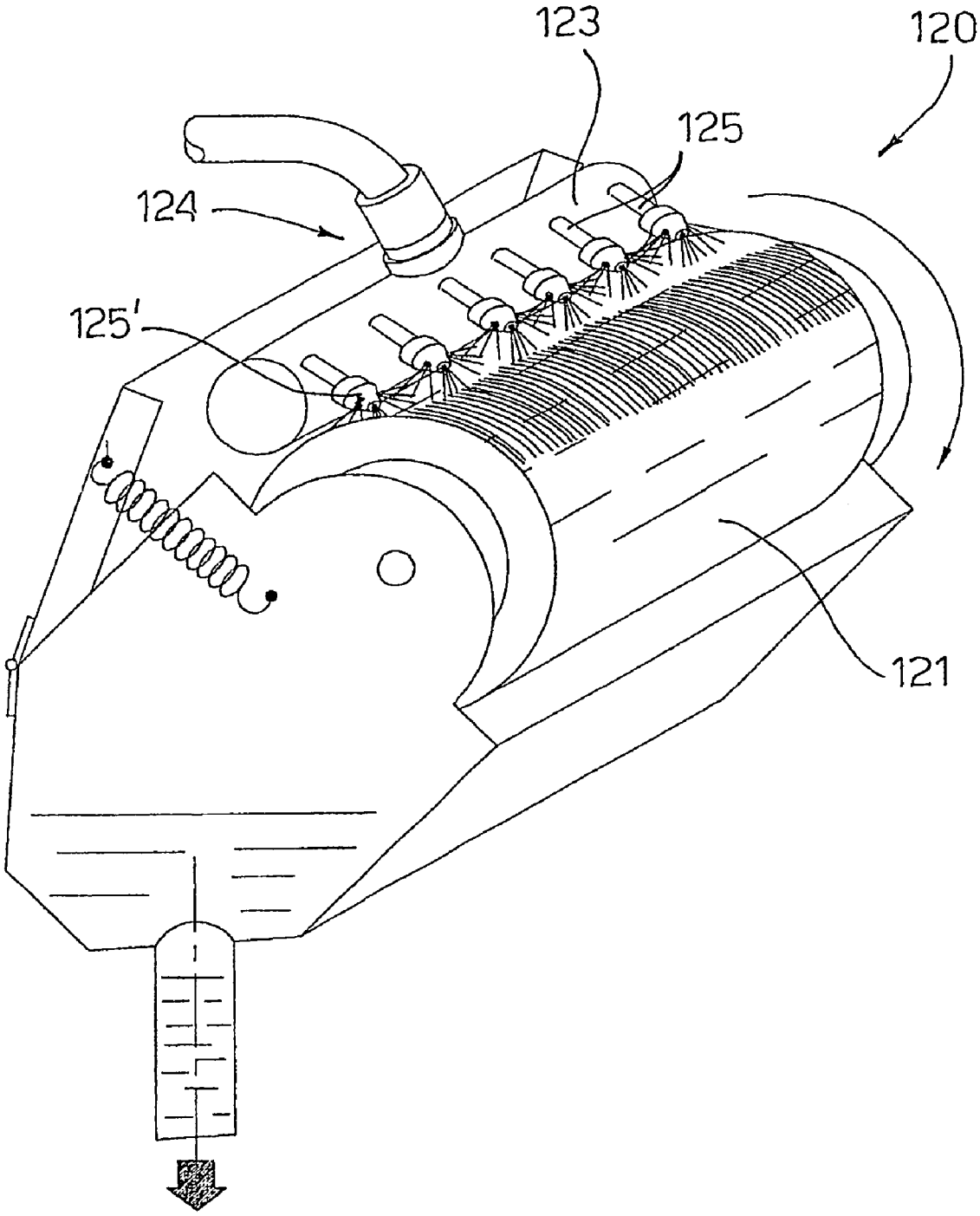
FIG. 11 is an axonometric view of the eleventh embodiment of the painting device.

Embodiment 120 in FIG. 11 is similar to that in the previous illustration, except that the manifold 123 of applier 124 provides dispensing channels 125 providing nozzles 125' with spray in several directions.

The manifolds (13; 33; . . . ) of appliers of FIGS. 1 to 11 include only one internal chamber connected to a supply duct (16; 36; . . . .).

FIG. 12 shows a top view (FIG. 12*a*) and a side view (FIG. 12*b*) of a painting device (a brush providing an applier of the type shown by FIG. 4) providing a second embodiment of an applier in accordance with the invention, generally indicated by reference 200, which differs from appliers of FIGS. 1 to 11 essentially in that its manifold 203 includes two chambers 204 (FIG. 14) connected to the supply duct 206 through a distribution device 207 and two further ducts 208, each of which connects a output 209 of the distribution device 207 (FIG. 13) with the input 210 of one of chambers 204 of the manifold 203. Small feeding channels 205 supplying the paint to the painting device are further shown in FIG. 12; they could provide distributor nozzles at their ends. The applier 200 can be used with painting devices of any type as, for example, those shown by FIGS. 1 to 11.

The two-chambers manifold 203 involves some advantage with respect to the one-chamber manifolds (13; 33; . . . ) of appliers of FIGS. 1 to 11. Firstly, the paint is supplied to manifold 203 into chambers 204 of reduced length through two spaced inputs 210, improving therefore an uniform distribution of the paint on the whole length of manifold 203, of the painting device and on the surface to be painted. Furthermore, when a painting device comprising an one-chamber manifold is used on a standing position the paint concentrates on the bottom portion of the manifold and of the painting device, distributing therefore on a not uniform way on the surface to be painted and dropping on the floor: the two-chambers manifold 203 provides an uniform distribution of the paint on the painting device and on the surface to be painted and avoids (or, at least, reduces) the risk that the paint could drop on the floor. Said advantages are particularly relevant if the painting device is a roll. Furthermore, FIG. 12*b* shows flow adjusting means 220 (better disclosed with reference to FIG. 16) which differs from flow adjusting means 20 essentially in that it provides at least a second adjusting screw 27' and a flow blocking lever 28 (FIG. 16). Flow-adjusting means 220 can be used for any of the above described appliers (FIGS. 1 to 11) in place of flow adjusting means 20.

Without diverting from the scope of the invention, each chamber 204 of manifold 203 can be connected to a supply duct, providing flow adjusting means (20, 220), which supplies the same paint or different paints: no distribution device 207 and no further ducts 208 are provided. When the two supply ducts supply different paints, manifold 203 has the further advantage that two adjacent portions of a surface can be painted with different paints.

FIG. 13 is a side view (FIG.13*a*) and a sectional top view (FIG. 13*b*) of the distribution device 207 of the applier 200 of FIG. 12, wherein a Y-shaped opening is realised to share between outputs 209 the paint flowing from a supply duct. On the preferred embodiment show by FIG. 13*b*, near each output 209 of the distribution device 207 a valve closing the relevant output 209 is provided; FIG. 13 shows already known valves comprising cylindrical holes 212 realised on the distribution device 207 wherein cylindrical holed bodies 211 (FIG. 13*c*) are positioned but any different type of already known valve can be used. Said valves can be omitted without departing from the scope of the invention.

FIG. 14 is a sectional top view of the manifold 203 of FIG. 12, which shows the two chambers 204, their inputs 210 and a plurality of holes connecting said chambers 204 to dispensing channels 205, omitted in FIG. 14.

FIG. 15 is a bottom view (FIG. 15*a*) and a sectional side view (FIG. 15*b*) of a manifold 203' to be used with a roller type painting device in place of manifold 203 of FIG. 12: FIG. 15*b* shows the two chambers 204', their inputs 210' and a plurality of holes connecting said chambers 204' to dispensing channels 205, omitted in FIG. 15. When supplied through the distribution device 207 of FIG. 13 the two-chambers manifold (203; 203') has the further advantage that the width of the painted surface can be reduced to about one half of the painting device width by closing one of said valves.

FIG. 16 is a top view (FIG. 16*a*), a front view (FIG. 16*b*) and a sectional side view (FIG. 16*c*) of the flow adjusting means 220 of FIG. 12 which differs from the flow adjusting means 20 of FIG. 1*a* (comprising a substantially tubular body 21 defining an internal chamber for a supply duct, a lever 24 providing the shutter 25 which extends into the internal chamber, at least a spring 26 acting on the lever 24 to push the shutter 25 into the internal chamber for crushing the supply duct and a lever adjusting screw 27) by further comprising a second lever adjusting screw 27' and a flow blocking lever 28, comprising a cam 29, which can be omitted without departing from the scope of the invention. Acting on the lever adjusting screw 27 the operator adjusts the amount of paint supplied to the painting device when he pushes on the lever 24; acting on the second lever adjusting screw 27' the operator adjusts the amount of paint supplied to the painting device when he does not push on the lever 24; acting on the flow blocking lever 28 the operator crushes completely, through the cam 29, the supply duct 206 blocking the paint supply.

FIG. 17 is a top view (FIG. 17*a*) and a side view (FIG. 17*b*) of a painting device (a roller 301) providing a third embodiment of an applier in accordance with the invention, generally indicated by reference 300, which differs from the applier 200 of FIG. 12 essentially in that its manifold 303, pressed on the roller 301 by at least a spring 302, includes four chambers 304 (FIG. 18) connected to the supply duct 306 through a distribution device 307 and four further ducts 308, each of which connects a output 309 of the distribution device 307 (FIG. 19) with the input 310 of one of chambers 304 of the manifold 303. Finally, FIG. 17 shows a flow adjusting means 320 whose description is omitted as it is corresponding to the flow adjusting means 20 of FIG. 1*a* or to the flow adjusting means 220 of FIG. 16. The applier 300 can be used with painting devices of any type as, for example, those shown by FIGS. 1 to 11.

FIG. 18 is a bottom view (FIG. 18*a*) and a sectional side view (FIG. 18*b*) of the manifold 303 of FIG. 17, which shows the four chambers 304, their inputs 310 and a plurality of holes connecting said chambers 304 to dispensing channels, if any, omitted in FIGS. 17 and 18.

FIG. 19 is a side view (FIG. 19*a*) and a sectional top view (FIG. 19*b*) of the distribution device 307 of the applier 300 of FIG. 17, wherein two Y-shaped openings, connected to each other, are constructed to share between outputs 309 the paint flowing from the supply duct 306 and from a further supply duct 306', if any, abutted to a hole 315 realised on the distribution device 307 at the input of the Y-shaped opening nearest to outputs 309. The two Y-shaped openings can be separated each other by a blocking device 313 (for example a plug, as shown in FIG. 19*a*) positioned in a hole realised on the distribution device 307 and closing the input of the Y-shaped opening nearest to outputs 309. On the preferred embodiment show by FIG. 19, near each output 309 of the distribution device 307 a valve is provided, which could be omitted without departing from the scope of the invention. FIG. 19 show already known valves comprising cylindrical holes 312 realised on the distribution device 307 wherein cylindrical holed bodies 311 (FIG. 19*c*) are positioned but any different type of already know valve can be used.

FIG. 20 is a side view (FIG. 20*a*) and a sectional top view (FIG. 20*b*) of the distribution device 307 of FIG. 19 wherein the blocking device 313 and the further supply duct 306' (FIG. 21) have been omitted and the relevant holes on the distribution device 307 (FIG. 20*b*) are closed by plugs 314. The four-chambers manifold 303 has the same advantages of the two-chambers manifold 203; when supplied through the distribution device 307 the four-chambers manifold 303 has the further advantage that a surface of reduced width (from about one quarter to about three quarters of the painting device width) can be painted by closing one or more of said valves. Without diverting from the scope of the invention, each chamber 304 of manifold 303 can be connected to a supply duct providing a flow adjusting means (20, 220) and supplying the same paint or different paints: no distribution device 307 and no further ducts 308 are provided. When the four supply ducts supply different paints, manifold 303 has the further advantage that two adjacent portions of a surface can be painted with different paints.

FIG. 21 is a top view (FIG. 21*a*) and a side view (FIG. 21*b*) of the painting device of FIG. 17 providing flow adjusting means 320 and two supply ducts (306, 306'), the supply duct 306' being connected to the hole 315 (FIG. 19*b*) of the distribution device 307. When two supply ducts (306; 306') are provided and the supply duct 306' supplies a paint different from that supplied by duct 306, the four-chambers manifold 303 has the further advantage that two or more adjacent portions of a surface can be painted with different paints by adjusting said flow adjusting means open or closed to connect each output 309 of the distribution device 307 with one of said supply ducts (306, 306'), the width of each of said adjacent portions being about a quarter of the painting device width.

FIG. 22 is a top view (FIG. 22*a*), a front view (FIG. 22*b*) and a sectional side view (FIG. 22*c*) of the flow adjusting means 320 of FIG. 21, which differs from that shown in FIG. 16 essentially in that its body 321 defines one internal chambers for each supply duct (306, 306', not shown in FIG. 22), in that the shutter 25 provided by the lever 24 crushes both supply duct (306, 306') and in that it provides for each supply duct (306, 306') a flow blocking lever (28, 28') comprising a cam 29, which can be omitted without departing from the scope of the invention.

FIG. 23 is a top view (FIG. 23*a*) and a side view (FIG. 23*b*) of a painting device (a roller) providing a fourth embodiment of an applier in accordance with the invention, generally indicated by reference 400, which differs from above described ones essentially in that it includes manifold moving means (402, 405, 408, 410, 428) for resting the manifold 403 against or taking it away from the roller. Manifold 403 is supported by a movable arm 408 hinged to fixed arm(s) 409 supporting the roller 401 and urged by a spring 402 taking it away from the roller 401: said movable arm 408 is further connected through a tie rod 410 to a trigger 428 so that the operator, acting on the trigger 428, rests the manifold 403 against the roller 401. In FIG. 23 between the tie rod 410 and the movable arm 408 a spring 405 is positioned, which could be omitted (as shown in FIG. 23A) without departing from the scope of the invention. On a preferred embodiment, trigger 428 is integral with the lever 28 (FIG. 16) so that the manifold 403 is at the same time rested against the roller 401 and supplied with paint. FIG. 23 shows the supply duct 406, a two-chamber manifold 403 corresponding to the manifold 203' of FIG. 15, flow adjusting means 420 corresponding to means 20 of FIG. 1*a* and a distribution device 407 corresponding to device 207 of FIG. 13 but, without departing from the scope of the invention, applicator 400 can include a four-chamber manifold corresponding to manifold 303 of FIG. 17, flow adjusting means corresponding to means 20 of FIG. 1*a* or to means 320 of FIG. 22 and a distribution flow device 407 corresponding to device 307 of FIG. 17. The applier 400 can be used with painting devices of any type providing a roller as, for example, those shown by FIGS. 2, 5, 6, 7, 9, 10, 11, 17 and 21.

FIG. 24 is a top view (FIG. 24*a*) and a side view (FIG. 24*b*) of a painting device (a roller) providing a fifth embodiment of an applier in accordance with the invention, generally indicated by reference 500, which differs from that shown by FIG. 23 essentially in the manifold moving means (502, 508, 510, 528) for resting the manifold 503 against or taking it away from the roller 501. Manifold 503 is supported by a movable arm 508 hinged to fixed arm(s) 509 supporting the roller 501 and urged by a spring 502 resting it against the roller 501: said movable arm 508 is further connected through a tie rod 510 to a trigger 528 so that the operator, acting on the trigger 528, takes the manifold 503 away from the roller 501. The applier 500 can be used with painting devices of any type providing a roller as, for example, those shown by FIGS. 2, 5, 6, 7, 9, 10, 11, 17 and 21.

FIG. 24 shows the supply duct 506, a two-chamber manifold 503 corresponding to the manifold 203' of FIG. 15, flow adjusting means 520 corresponding to means 20 of FIG. 1*a* and a distribution device 507 corresponding to device 207 of FIG. 13 but, without departing from the scope of the invention, applicator 500 can include a four-chamber manifold corresponding to manifold 303 of FIG. 17, flow adjusting means corresponding to means 20 of FIG. 1*a* or to means 320 of FIG. 22 and a distribution flow device 407 corresponding to device 307 of FIG. 17.

FIG. 25 is a top view (FIG. 25*a*) and a side view (FIG. 25*b*) of a painting device (a short handle brush) providing a sixth embodiment of an applier in accordance with the invention, generally indicated by reference 600, which differs from that shown by FIG. 12 essentially in that the manifold moving means (601, 628) moves the manifold 603 along the brush head 611. Small feeding channels 605 supplying the paint to the painting device are further shown in FIG. 25; they could provide distributor nozzles at their ends. It is Applicant's experience that, when the brush is used on a standing position, the paint concentrates near the rib part of the brush head, affecting the quality of the paint layer realised an upper horizontal surface as, for example, a ceiling. To overcome said drawback, manifold 603 is supported by a jointed arm 601 and connected to a trigger 628 so that the operator, acting on the trigger 628, moves the manifold 603 to the working position shown in dotted lines in FIG. 25, supplying paint to the end of the brush head nearest to the upper horizontal surface to be painted. On a preferred embodiment, trigger 628 is integral with the lever 28 (FIG. 16) so that the manifold 603 is at the same time moved on said working position and supplied with paint. The applier 600 can be used with painting devices of any type providing a brush as, for example, those shown by FIGS. 1, 3, 4, 8 and 12. FIG. 25 shows a four-chamber manifold 603 corresponding to the manifold 303 of FIG. 17, flow adjusting means 620 corresponding to means 20 of FIG. 1*a* or to means 320 of FIG. 22 and a distribution flow device 607 corresponding to device 307 of FIG. 19 but, without departing from the scope of the invention, applicator 600 can include a two-chamber manifold corresponding to manifold 203 of FIG. 14, flow adjusting means corresponding to means 20 of FIG. 1 and a distribution flow device corresponding to distribution device 207 of FIG. 13.

Without departing from the scope of the invention, the appliers to be used with roller type painting devices can provide for a further manifold, positioned near the manifold disclosed with reference to the above embodiments: a description of said further manifolds is omitted as they are corresponding to the manifolds near which they are positioned.

FIG. 26 shows very schematically a top view of a roller type painting device providing for said further embodiment of an applier in accordance with the invention, including two manifolds positioned each other.

Although the descriptions of the embodiments have been given with reference to a painting device, roller or brush, incorporating an applier, it must be clear that the invention also refers to an applier made separately, for instance comprising a manifold with holes or small channels and the relevant flexible hose, such as the appliers indicated by 14, 34,

54, 64, 74, 84, 94, 104, 114, 124, 200, 300, 400, 500, 600; such appliers can represent an article that can be marketed separately for fitting to an existing brush or roller, and in this case, means will be provided, in themselves known, to make these integral with a brush or roller, for example coupling means.

In particular, it should be noted that an applier according to this application could be applied to a painting unit as disclosed in the patent application no. MI2001A001661 in the name of the same applicant.

Generally, the system adapts to any type of roller or brush of any shape.

A skilled in the art could conceive any further variations with respect to what has been described; nonetheless such variations accessible to a skilled in the art are intended comprised within the scope of the invention as set forth in the claims.

The invention claimed is:

1. A painting device having a paint feeder comprising a hollow manifold having at least two separate internal chambers, and openings in fluid communication with said chambers for dispensing paint;

a distribution device connected to a paint supply duct and being separate and spaced from said manifold, said distribution device comprising at least two output ducts connected separately to said manifold chambers, and a plug or valve in said distribution device for closing an output duct to prevent the flow of paint to the manifold chamber connected thereto;

said painting device having a painting head, said paint feeder being positioned outside of and connected to said painting head for dispensing paint to said painting head.

2. Device as claimed in claim 1 wherein said supply duct is a flexible hose, and a flow adjusting device is provided on said flexible hose.

3. Device as claimed in claim 1 wherein said distribution device has a Y-shaped opening sharing between said output ducts the paint flowing from said supply duct.

4. Device as claimed in claim 1 wherein said manifold has four chambers, and said distribution device comprises four output ducts, each of which connects said distribution device with one of the chambers of said manifold.

5. A painting device having a paint feeder comprising a hollow manifold having at least two separate internal chambers, and openings in fluid communication with said chambers for dispensing paint;

a distribution device connected to a paint supply duct, said distribution device comprising at least two output ducts connected separately to said manifold chambers, and a plug or valve for closing an output duct to prevent the flow of paint to the manifold chamber connected thereto;

said painting device having a painting head, said paint feeder being positioned outside of and connected to said painting head for dispensing paint to said painting head;

wherein said supply duct is a flexible hose, and a flow adjusting device is provided on said flexible hose, said flow adjusting device comprises an engagement body on said flexible hose, a lever hinged on said engagement body and providing a shutter part pressed by a spring against said flexible hose, and an adjusting screw acting on said lever.

6. Device as claimed in claim 5 wherein said flow adjusting device further comprises a second adjusting screw acting on the said lever.

7. Device as claimed in claim 6 wherein said flow adjusting device further comprises a flow blocking lever comprising a cam for engaging said supply duct.

8. A painting device having a paint feeder comprising a hollow manifold having at least two separate internal chambers, and openings in fluid communication with said chambers for dispensing paint;

a distribution device connected to a paint supply duct, said distribution device comprising at least two output ducts connected separately to said manifold chambers, and a plug or valve for closing an output duct to prevent the flow of paint to the manifold chamber connected thereto;

said painting device having a painting head, said paint feeder being positioned outside of and connected to said painting head for dispensing paint to said painting head;

wherein said manifold has four chambers, and said distribution device comprises four output ducts, each of which connects said distribution device with one of the chambers of said manifold;

wherein said distribution device has two Y-shaped openings connected to each other and sharing between said output ducts the paint flowing from said supply duct, said two Y-shaped openings being separated by a blocking device movably positioned in a hole in said distribution device for closing the fluid connection of a Y-shaped opening to an output duct.

9. Device as claimed in claim 8 wherein a valve is provided in each output duct for selectively opening or closing it.

* * * * *